US007237859B2

(12) United States Patent
Usuda

(10) Patent No.: US 7,237,859 B2
(45) **Date of Patent: *Jul. 3, 2007**

(54) SYSTEM AND METHODS FOR PROVIDING A HEAD DRIVING DEVICE

(75) Inventor: Hidenori Usuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/889,130

(22) Filed: Jul. 13, 2004

(65) Prior Publication Data

US 2004/0246287 A1 Dec. 9, 2004

Related U.S. Application Data

(63) Continuation of application No. 10/379,806, filed on Mar. 6, 2003, now Pat. No. 6,779,863.

(30) Foreign Application Priority Data

Mar. 6, 2002 (JP) ..... 2002-060710

(51) Int. Cl.
*B41J 29/38* (2006.01)

(52) U.S. Cl. ..... 347/9

(58) Field of Classification Search ..... 347/9–11, 347/14

See application file for complete search history.

(56) References Cited

U.S. PATENT DOCUMENTS 5,631,675 A * 5/1997 Futagawa ..... 347/10
6,158,905 A 12/2000 Endo
2004/0056931 A1 3/2004 Hadimioglu et al. ..... 345/75

FOREIGN PATENT DOCUMENTS

| | | |
|---|---|---|
| JP | 8-011347 | 1/1996 |
| JP | A 08-156248 | 6/1996 |
| JP | 11248927 A | 9/1999 |
| JP | A 11-286142 | 10/1999 |
| JP | 2000280456 A | 10/2000 |

OTHER PUBLICATIONS

Korean Office Action, Not translated.

* cited by examiner

*Primary Examiner*—Julian D. Huffman
(74) *Attorney, Agent, or Firm*—Oliff & Berridge, PLC

(57) ABSTRACT

The present invention provides a head driving device and method capable of ejecting a necessary amount of a viscous body from a head including a pressure generating element, such as a piezoelectric element, a droplet ejecting apparatus including the head driving device, a head driving program, and a device manufacturing method including, as one manufacturing step, a step of ejecting a viscous body using the method. The invention can be achieved by applying a drive signal COM to a pressure generating element, such as a piezoelectric element included in a head. A clock signal can be supplied to a drive signal generating circuit that generates the drive signal COM. The drive signal generating circuit generates the drive signal in synchronization with the clock signal. According to the present invention, the rate of change in voltage value of the drive signal per unit time is changed by changing the frequency of the clock signal in accordance with a deformation rate of the pressure generating element per unit time.

9 Claims, 16 Drawing Sheets

SYSTEM AND METHODS FOR PROVIDING A HEAD DRIVING DEVICE

This is a Continuation of U.S. patent application Ser. No. 10/379,806, filed Mar. 6, 2003 now U.S. Pat. No. 6,779,863. The entire disclosure of the prior application is hereby incorporated by reference herein in its entirety.

BACKGROUND OF THE INVENTION

1. Field of Invention

The present invention relates to head driving devices and methods, droplet ejecting apparatuses, head driving programs, device manufacturing methods, and devices. More particularly, the present invention relates to a head driving device and method for driving a head that ejects a highly viscous body, such as a liquid resin having high viscosity, a droplet ejecting apparatus including the head driving device, a head driving program, a device manufacturing method including, as one step, a step of ejecting a viscous body using the above-described method and manufacturing a liquid crystal display, an organic EL (Electroluminescence) display, a color filter substrate, a microlens array, an optical device having a coating layer, and other devices, and a device thereof.

2. Description of Related Art

Recently, various electronic devices, such as computers and handheld information devices, have been advancing greatly. In accordance with the advancement of the electronic devices, electronic devices having liquid crystal displays, and particularly color liquid crystal displays showing high display performance, have been increasing in number. Despite their size, color liquid crystal displays are capable of having a high display performance, and therefore applications for such devices have been expanding. A color liquid crystal display has a color filter substrate for colorizing an image to be displayed. Various methods for manufacturing the color filter substrate have been proposed. One such method proposed is a droplet ejecting method for causing R (red), G (green), and B (blue) droplets to land on the substrate in a predetermined pattern.

A droplet ejecting apparatus implementing the droplet ejecting method has a plurality of droplet ejecting heads that eject droplets. The droplet ejecting heads each have a fluid chamber for temporarily accumulating an external droplet, a piezoelectric element serving as a drive source that pressurizes a fluid in the fluid chamber to eject a predetermined amount of the fluid, and a nozzle face having a nozzle drilled therein, from which the droplet from the fluid chamber is ejected. These droplet ejecting heads are disposed at equal pitches and thus make a head group. While the head group scans the substrate along a scanning direction (for example, X direction), the droplets are ejected. As a result, the R, G, and B droplets land on the substrate. In contrast, the positional adjustment on the substrate in the direction orthogonal to the scanning direction (for example, Y direction) is made possible by moving a platform on which the substrate is placed.

SUMMARY OF THE INVENTION

The manufacture of the color filter substrate included in the above-described color liquid crystal display more often uses a highly viscous body having a higher viscosity than that of ink for use in color printers used at home. Since a less viscous body (for example, a viscous body having a viscosity of approximately 3.0 [mPa·s (milli·Pascal·second)] at room temperature (25° C.)) has a low viscosity resistance, the color printer used at home can eject a necessary amount of droplet even when a driving period of a piezoelectric element is short (for example, a few microseconds). Because the color printer used at home is required to achieve high-speed printing, a head driving device that drives a droplet ejecting head is designed to vibrate the piezoelectric element at high speed in order to achieve high-speed printing.

For example, a known head driving device includes a drive signal generator for receiving data that indicates the amount of change in voltage value of a drive signal applied to the piezoelectric element per reference clock and a clock signal that defines a period during which the voltage value of the drive signal is changed and for generating the drive signal on the basis of the data and the clock signal in synchronization with the reference clock. The reference clock input to the drive signal generator has a frequency of approximately 19 MHz. The data is a signed digital signal having approximately 10 bits. Until the above-described clock signal is input to the drive signal generator, the drive signal generator adds the value of the input data every time the reference clock is input, thereby generating a rising or falling waveform of the drive signal.

In the known head driving device, a drive signal having a steeply rising or falling waveform is generated by greatly increasing or decreasing the value of the data input to the drive signal generator. For example, when the data having the maximum value or minimum value (negative value) is input to the drive signal generator, a drive signal that suddenly rises or falls over the time of one cycle of the reference clock is generated. As a matter of fact, since a D/A converter disposed between the drive signal generator and the piezoelectric element has a response delay, the period during which the drive signal rises or falls is longer than the time of one cycle of the reference clock.

In contrast, a drive signal having a gradually rising or falling waveform is generated by decreasing the value of the data input to the drive signal generator and by inputting the clock signal at a later time. In order to simplify the description, it is assumed that the data is an unsigned 10-bit digital signal. In this case, there are $2^{10}=1024$ possible combinations for the value of the drive signal. When the data having the minimum value is input in order to generate a gradually rising waveform, the voltage value of the drive signal changes from the minimum value to the maximum value over a period of 1024 clocks of the reference clock. When the reference clock is at 10 MHz, the time of one cycle is 0.1 μs. Theoretically speaking, the period during which the drive signal rises or falls is variable within the range from approximately 0.1 to 102.4 μs.

As described above, a highly viscous body is used in the droplet ejecting apparatus for use in manufacturing a color filter substrate. It is thus necessary to vibrate the piezoelectric element for a long period of time in order to eject a necessary amount of droplet. For example, the manufacture of a color filter involves vibrating the piezoelectric element for a few milliseconds. The manufacture of a microlens involves vibrating the piezoelectric element for a long period of time of approximately one second. As described above, the known head driving device is designed to vibrate the piezoelectric element at high speed, and the maximum time during which the drive signal rises or falls is approximately 102.4 μs. There is a problem in that the head driving device used at home cannot be simply used as the head driving device of the droplet ejecting apparatus for ejecting a highly viscous body.

This problem does not only arises in the manufacture of a color filter substrate of a liquid crystal display, but also arises in the manufacture of an organic EL (Electroluminescence) display, the manufacture of a microlens array using a highly viscous transparent liquid resin, the formation of a coating layer on the surface of an optical element such as a spectacle lens using a highly viscous liquid resin, or the like. In short, the problem is a general problem with a device manufacturing method having, as one manufacturing step, a step of ejecting a viscous body.

In view of the foregoing circumstances, it is an object of the present invention to provide a head driving device and method for ejecting a necessary amount of a viscous body from a head having a pressure generating element, such as a piezoelectric element, a droplet ejecting apparatus including the head driving device, a head driving program, a device manufacturing method including, as one manufacturing step, a step of ejecting a viscous body using the above-described method, and a device manufactured using the droplet ejecting apparatus or the device manufacturing method.

In order to solve the foregoing problems, a head driving device of the present invention is a head driving device operating in synchronization with a reference clock and ejecting a viscous body by applying a drive signal to a pressure generating element included in a head, and thus deforming the pressure generating element. The head driving device includes frequency changing means for changing the frequency of the reference clock in accordance with a deformation rate of the pressure generating element per unit time.

According to the present invention, the frequency of the reference clock that defines the operation timing of the head driving device that generates the drive signal applied to the pressure generating element can be changed in accordance with the deformation rate of the pressure generating element per unit time. Both the drive signal whose value gradually changes and the drive signal whose value suddenly changes in accordance with the frequency of the reference clock are easily generated. As a result, the deformation rate of the pressure generating element per unit time is easily controlled.

In order to eject a necessary amount of a highly viscous body, the viscous body needs to be gradually pulled into the head and then ejected at a certain degree of speed. The pressure generating element thus needs to be gradually deformed and then to be quickly restored. According to the present invention, both the drive signal whose value gradually changes and the drive signal whose value suddenly changes in accordance with the frequency of the reference clock are easily generated. The present invention is thus highly suitable to ejecting the viscous body.

In the head driving device of the present invention, the frequency changing device can change the frequency of the reference clock by dividing the reference clock.

According to the present invention, the frequency of the reference clock can be changed by dividing the reference clock. Changing the frequency of the reference clock does not involve a great change in the device configuration. As a result, the implementation of the present invention requires almost no increase in the cost. As discussed above, the present invention is implementable using some of the configuration of a known device. By using the known device, the resource can be utilized.

In the head driving device of the present invention, preferably the deformation rate of the pressure generating element (48*a*) per unit time is set in accordance with the viscosity of the viscous body. It is preferable that the viscosity of the viscous body be within the range from 10 to 40000 [mPa·s] at room temperature (25° C.).

According to the present invention, setting the deformation rate of the pressure generating element per unit time in accordance with the viscosity of the viscous body makes it possible to perform a variety of control modes, such as deforming a highly viscous body over a long period of time while deforming a less viscous body over a short period of time. Such control modes are highly suitable to ejecting a necessary amount of viscous body.

In the head driving device of the present invention, the pressure generating element (48*a*) includes a piezoelectric vibrator that generates stretching vibrations or flexible vibrations upon application of the drive signal (COM) and pressurizes the viscous body. According to the present invention, both the head having the piezoelectric vibrator that generates stretching vibrations and that serves as the pressure generating element and the head having the piezoelectric vibrator that generates flexible vibrations and that serves as the pressure generating element are driven. The present invention is thus applicable to various devices without involving a great change in the device configuration.

The head driving device of the present invention further includes a drive signal generator that generates, when intermittently applying the drive signal to the pressure generating element, the drive signal including an auxiliary drive signal for setting the surface state of the viscous body to a predetermined state. According to the present invention, the pressure generating element is driven by the drive signal that includes the auxiliary drive signal for setting the surface state of the viscous body to the predetermined state. When the viscous body is ejected, the surface state of the viscous body is maintained at the predetermined state. This is very advantageous in continuously ejecting a necessary amount of the viscous body.

In order to solve the foregoing problems, a head driving method of the present invention is a head driving method for a head driving device operating in synchronization with a reference clock and ejecting a viscous body by applying a drive signal to a pressure generating element included in a head and thus deforming the pressure generating element. The method includes a frequency changing step of changing the frequency of the reference clock in accordance with a deformation rate of the pressure generating element per unit time.

According to the present invention, the frequency of the reference clock that defines the operation timing of the head driving device that generates the drive signal applied to the pressure generating element is changed in accordance with the deformation rate of the pressure generating element per unit time. Both the drive signal whose value gradually changes and the drive signal whose value suddenly changes in accordance with the frequency of the reference clock are easily generated. As a result, the deformation rate of the pressure generating element per unit time is easily controlled.

In order to eject a necessary amount of highly viscous body, the viscous body needs to be gradually pulled into the head and then ejected at a certain degree of speed. The pressure generating element thus needs to be gradually deformed and then to be quickly restored. According to the present invention, both the drive signal whose value gradually changes and the drive signal whose value suddenly changes in accordance with the frequency of the reference clock are easily generated. The present invention is thus highly suitable to ejecting the viscous body.

In the head driving method of the present invention, in the frequency changing step, the frequency of the reference clock is changed by dividing the reference clock. According to the present invention, the frequency of the reference clock is changed by dividing the reference clock. The frequency of the reference clock can thus be changed without complicated control. Preferably, the head driving method of the present invention further includes a selection step of selecting a division ratio of the reference clock in accordance with the deformation rate of the pressure generating element.

In the head driving method of the present invention, preferably the deformation rate of the pressure generating element per unit time is set in accordance with the viscosity of the viscous body. It is preferable that the viscosity of the viscous body be within the range from 10 to 40000 [mPa·s] at room temperature (25° C.).

According to the present invention, setting the deformation rate of the pressure generating element per unit time in accordance with the viscosity of the viscous body makes it possible to perform a variety of control modes, such as deforming a highly viscous body over a long period of time while deforming a less viscous body over a short period of time. Such control modes are highly suitable to ejecting a necessary amount of viscous body.

The head driving method of the present invention further includes an auxiliary drive signal applying step of applying an auxiliary drive signal for setting the surface state of the viscous body to a predetermined state prior to or subsequent to applying the drive signal for ejecting the viscous body to the pressure generating element.

According to the present invention, the pressure generating element is driven by the drive signal that includes the auxiliary drive signal for setting the surface state of the viscous body to the predetermined state. When the viscous body is ejected, the surface state of the viscous body is maintained at the predetermined state. This is very advantageous in continuously ejecting a necessary amount of the viscous body.

In order to solve the foregoing problems, a droplet ejecting apparatus of the present invention includes any one of the above-described head driving devices. According to the present invention, since the droplet ejecting apparatus includes the above-described head driving device, the droplet ejecting apparatus that ejects a necessary amount of the viscous body can be achieved without adding a great change to the configuration of the apparatus.

In order to solve the foregoing problems, a head driving program of the present invention is a program for performing any one of the above-described head driving methods.

In order to solve the foregoing problems, a device manufacturing method of the present invention includes, as one device manufacturing step, a step of ejecting a viscous body using any one of the above-described head driving methods. According to the present invention, since necessary amounts of various viscous bodies can be ejected, devices according to various specifications can be manufactured.

In order to solve the foregoing problems, a device of the present invention is manufactured using the above-described droplet ejecting apparatus or the above-described device manufacturing method. According to the present invention, since a device is manufactured using the apparatus or method that can eject necessary amounts of various viscous bodies, devices according to various specifications can be manufactured.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

With reference to the drawings, a head driving device and method, a droplet ejecting apparatus, a head driving program, a device manufacturing method, and a device according to an embodiment of the present invention will now be described in detail. In the following description, first, an example of a device manufacturing system which includes a droplet ejecting apparatus and which is used when manufacturing a device, a device manufactured using the device manufacturing system, and a device manufacturing method will be described. Second, a head driving device included in the droplet ejecting apparatus, a head driving method, and a head driving program will be described in turn.

Figure 1:
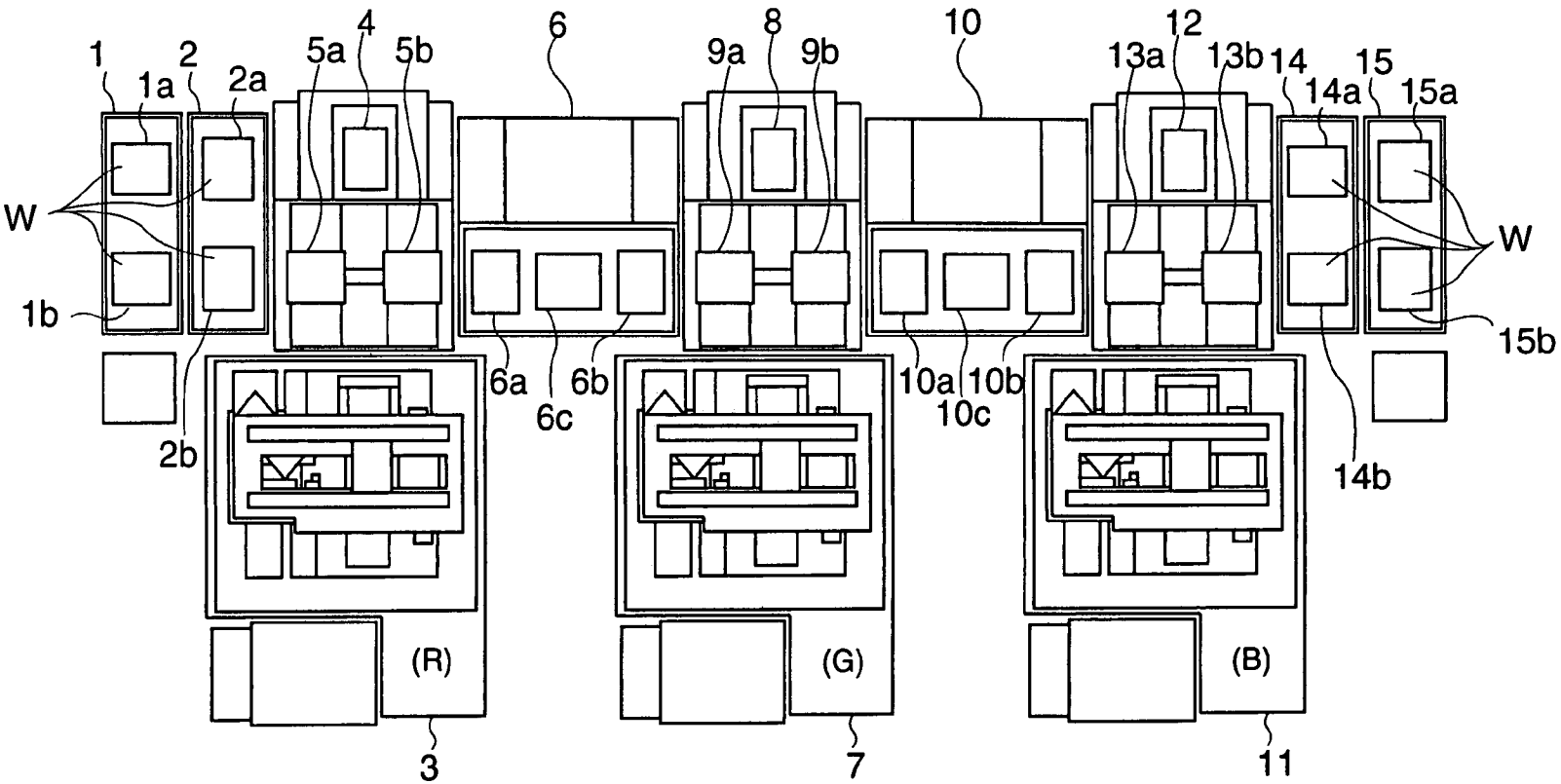
FIG. 1 is a plan view showing the entire configuration of a device manufacturing system including a droplet ejecting apparatus according to an embodiment of the present invention.

FIG. 1 is a plan view showing the overall configuration of a device manufacturing system including a droplet ejecting apparatus according to an embodiment of the present invention. As shown in FIG. 1, the device manufacturing system can include a droplet ejecting apparatus includes a wafer supplier 1 that receives a substrate to be processed (glass substrate, which will be referred to as a wafer W hereinafter), a wafer rotating unit 2 that determines the plotting direction of the wafer W transferred from the wafer supplier 1, a droplet ejecting apparatus 3 that causes an R (red) droplet to land onto the wafer W transferred from the droplet ejecting apparatus 3, a baking furnace 4 that dries the wafer W transferred from the wafer rotating unit 2, robots 5*a* and 5*b* that transfer the wafer W between the components, an intermediate transferring unit 6 that cools the wafer W and determines the plotting direction before sending the wafer W transferred from the baking furnace 4 to the subsequent step, a droplet ejecting apparatus 7 that causes a G (green) droplet to land onto the wafer W transferred from the intermediate transferring unit 6, a baking furnace 8 that dries the wafer W transferred from the droplet ejecting apparatus 7, and robots 9*a* and 9*b* that transfer the wafer W between the components. The device can further include an intermediate transferring unit 10 that cools the wafer W and determines the plotting direction before sending the wafer W transferred from the baking furnace 8 to the subsequent step, a droplet ejecting apparatus 11 that causes a B (blue) droplet to land onto the wafer W transferred from the intermediate transferring unit 10, a baking furnace 12 that dries the wafer W transferred from the droplet ejecting apparatus 11, robots 13*a* and 13*b* that transfer the wafer W between the components, a wafer rotating unit 14 that determines the receiving direction in which the wafer W transferred from the baking furnace 12 is received, and a wafer receiving unit 15 that receives the wafer W transferred from the wafer rotating unit 14.

The wafer supplier 1 can include two magazine loaders 1*a* and 1*b*, each having an elevator mechanism for vertically receiving, for example, 20 wafers W. The wafers W can be supplied one after another. The wafer rotating unit 2 determines the plotting direction in which the wafer W is plotted by the droplet ejecting apparatus 3 and determines the preliminary layout before transferring the wafer W to the droplet ejecting apparatus 3. With two wafer rotating tables 2*a* and 2*b*, wafers W are rotatably maintained precisely at 90-degree pitch intervals around the vertical axis. Since the droplet ejecting apparatuses 3, 7, and 11 will be described in detail below, descriptions thereof are omitted here.

The baking furnace 4 dries the red droplet on the wafer W transferred from the droplet ejecting apparatus 3 by, for example, having the wafer W in the heated environment at 120 degrees or lower for five minutes. Accordingly, disadvantages such as splattering of the red viscous body while the wafer W is being transferred are prevented. The robots 5*a* and 5*b* each have an arm (not shown) that can extend and rotate around a base. A vacuum attraction pad provided at the tip of the arm generates vacuum attraction to hold the wafer W in close proximity thereto. Accordingly, the wafer W is smoothly and efficiently transferred between the components.

The intermediate transferring unit 6 includes a cooler 6*a* that cools the heated wafer W transferred by the robot 5*b* from the baking furnace 4 before sending the wafer W to the subsequent step, a wafer rotating table 6*b* that determines the plotting direction in which the cooled wafer W is plotted by the droplet ejecting apparatus 7 and that determines the preliminary layout prior to transferring the wafer W to the droplet ejecting apparatus 7, and a buffer 6*c* that is provided between the cooler 6*a* and the wafer rotating table 6*b* and that absorbs a processing speed difference between the droplet ejecting apparatuses 3 and 7. The wafer rotating table 6*b* is designed to rotate the wafer W around the vertical axis at a 90-degree pitch or 180-degree pitch.

The baking furnace 8 has the same structure as that of the above-described baking furnace 4. For example, the baking furnace 8 dries the green droplet on the wafer W transferred from the droplet ejecting apparatus 7 by having the wafer W in the heated environment at 120 degrees or lower for five minutes. Accordingly, disadvantages, such as splattering of the green viscous body while the wafer W is being transferred, are prevented. The robots 9*a* and 9*b* have the same structures as those of the robots 5*a* and 5*b*. The robots 9*a* and 9*b* each have an arm (not shown) that can extend and rotate around a base. A vacuum attraction pad provided at the tip of the arm generates vacuum attraction to hold the wafer W in close proximity thereto. Accordingly, the wafer W is smoothly and efficiently transferred between the components.

The intermediate transferring unit 10 has the same structure as that of the above-described intermediate transferring unit 6. The intermediate transferring unit 10 can include a cooler 10*a* that cools the heated wafer W transferred by the robot 9*b* from the baking furnace 8 before sending the wafer W to the subsequent step, a wafer rotating table 10*b* that determines the plotting direction in which the cooled wafer W is plotted by the droplet ejecting apparatus 11 and that determines the preliminary layout prior to transferring the wafer W to the droplet ejecting apparatus 11, and a buffer 10*c* that is provided between the cooler 10*a* and the wafer rotating table 10*b* and that absorbs a processing speed difference between the droplet ejecting apparatuses 7 and 11. The wafer rotating table 10*b* is designed to rotate the wafer W around the vertical axis at a 90-degree pitch or 180-degree pitch.

The wafer rotating unit 14 can determine the rotating direction so that the wafer W having formed thereon R, G, and B patterns by the droplet ejecting apparatuses 3, 7, and 11, respectively, can face a particular direction. In other words, the wafer rotating unit 14 has two wafer rotating tables 14*a* and 14*b* and is designed to rotatably maintain the wafers W around the vertical axis precisely at 90-pitch intervals. The wafer receiving unit 15 has two magazine unloaders 15*a* and 15*b*, each having an elevator mechanism for vertically receiving, for example, 20 finished wafers W (color filter substrates) transferred from the wafer rotating unit 14. The wafers W can be received one after another.

Figure 2:
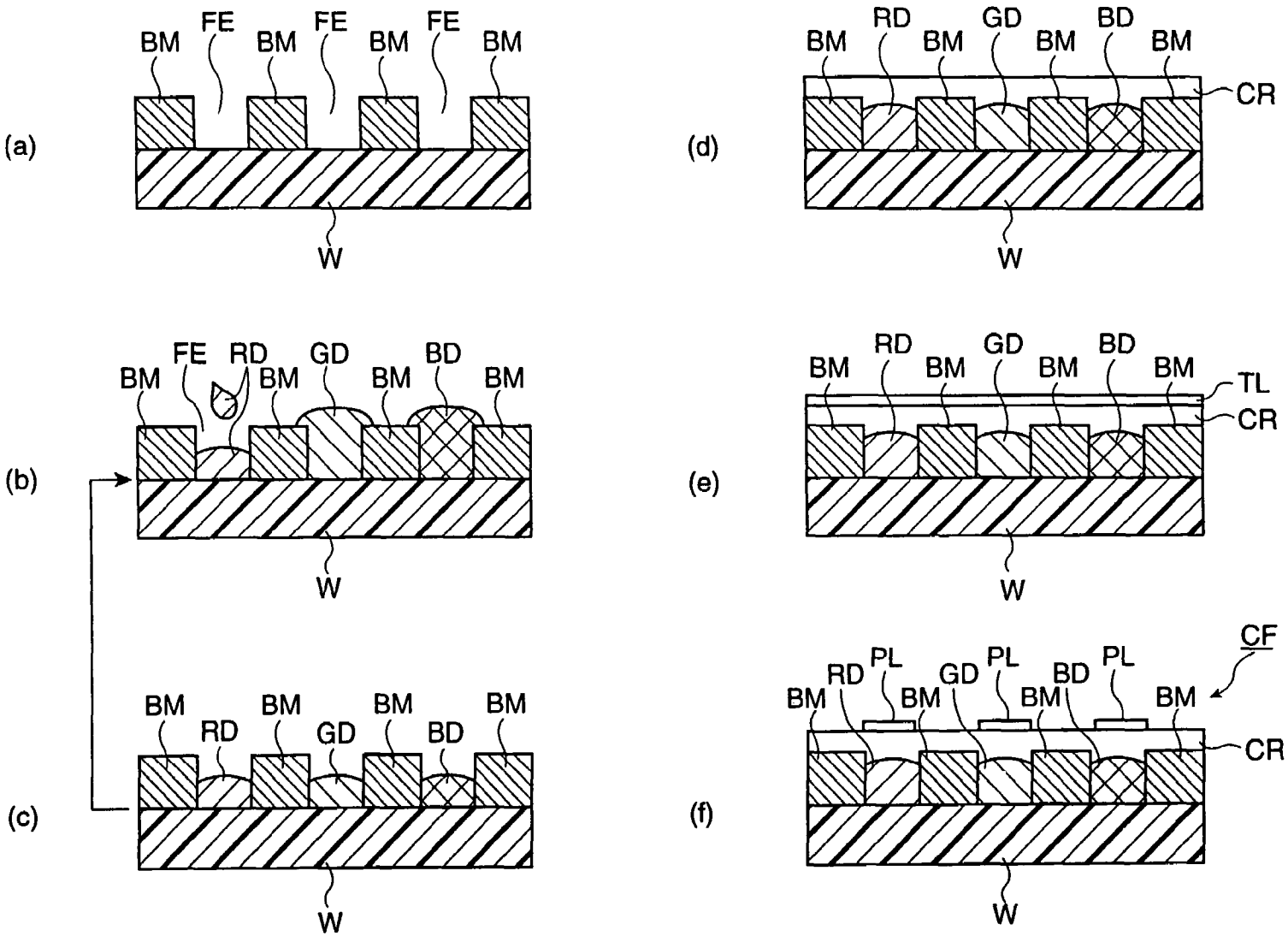
FIG. 2 includes illustrations showing a series of manufacturing steps of manufacturing a color filter substrate, the manufacturing steps including a step of forming an RGB pattern using the device manufacturing system.

An example of a device manufacturing method and a device manufactured by the device manufacturing method according to an embodiment of the present invention will now be described. In the following description, a case of a manufacturing method for manufacturing a color filter substrate using the above-described device manufacturing system will now be described. FIG. 2 shows a series of manufacturing steps of manufacturing a color filter substrate, the steps including a step of forming an RGB pattern using the device manufacturing system.

The wafer W for use in the manufacture of the color filter substrate is, for example, a transparent substrate formed of a rectangular sheet. The wafer W has an appropriate mechanical strength and high light transmissivity. For example, a transparent glass substrate, acrylic glass, plastic substrate, plastic film, or any of these types wherein the surface thereof has been treated is preferably used as the wafer W. In a front-end processing step prior to the RGB pattern forming step, a plurality of color filter areas are formed in advance in a matrix form on the wafer W in order to increase the productivity. In a back-end processing step subsequent to the RGB pattern forming step, these color filter areas are separated. As a result, the color filter areas are used as color filter substrates suitably adapted to the liquid crystal display.

Figure 3:
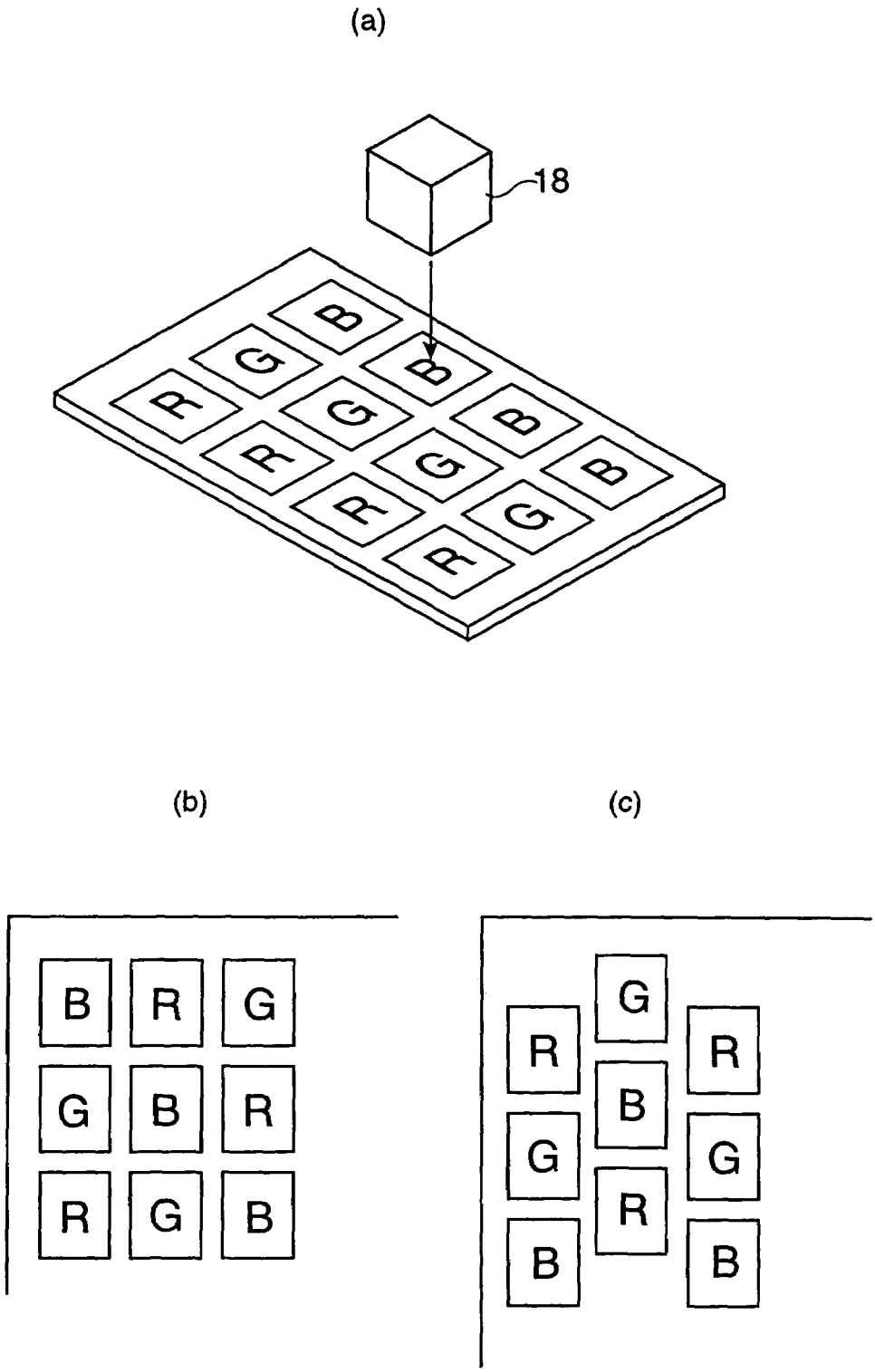
FIG. 3 illustrates examples of RGB patterns formed by droplet ejecting apparatuses included in the device manufacturing system, wherein (a) is a perspective view showing a stripe pattern, (b) is a fragmentary enlarged view showing a mosaic pattern, and (c) is a fragmentary enlarged view showing a delta pattern.

FIG. 3 includes illustrations showing examples of RGB patterns formed by the droplet ejecting apparatuses included in the device manufacturing system, wherein (a) is a perspective view showing a stripe pattern; (b) is a fragmentary enlarged view showing a mosaic pattern, and (c) is a fragmentary enlarged view showing a delta pattern. A predetermined pattern including an R (red) viscous body, a G (green) viscous body, and a B (blue) viscous body is formed on each of the color filter areas by droplet ejecting heads 18 described below. In addition to the strip pattern shown in FIG. 3(*a*), the pattern formed may be the mosaic pattern shown in FIG. 3(*b*) or the delta pattern shown in FIG. 3(*c*). In the present invention, no particular limitation is imposed on the pattern formed.

Referring back to FIG. 2, in a black matrix forming step, which is a front-end processing step, as shown in FIG. 2(*a*), one side of the transparent wafer W (side that will be the basis of the color filter substrate) is coated with a resin that transmits no light (preferably black) to a predetermined thickness (for example, approximately 2 μm) by a method such as spin coating. Subsequently, black matrices BM, . . . are formed in a matrix form by photolithography or the like. Minimum display elements defined by a grid of the black matrices BM, . . . are referred to as so-called filter elements FE, . . . . The filter elements FE, are windows, each of which is 30 μm in width in one direction of the side of the wafer W (for example, in the X-axis direction) and 100 μm in length in the direction orthogonal to this direction (for example, in the Y-axis direction). After the black matrices BM, . . . are formed on the wafer W, the resin on the wafer W is baked by applying heat to the wafer W by a heater (not shown).

The wafer W having formed thereon the black matrices BM is received by the magazine loader 1*a* or 1*b* of the wafer supplier 1, shown in FIG. 1. Continuously, the RGB pattern forming step is performed. In the RGB pattern forming step, the wafer W received in one of the magazine loaders 1*a* and 1*b* is held by the arm of the robot 5*a* and then placed on one of the wafer rotating tables 2*a* and 2*b*. One of the wafer rotating tables 2*a* and 2*b* determines the plotting direction and the layout, both of which serve as the prearrangement for causing a red droplet to land on the wafer W.

The robot 5*a* again holds the wafer W placed on one of the wafer rotating tables 2*a* and 2*b* and transfers the wafer W to the droplet ejecting apparatus 3. The droplet ejecting apparatus 3 causes, as shown in FIG. 2(*b*), red droplets RD to land onto the corresponding filter elements FE at predetermined positions for forming a predetermined pattern. The amount of each red droplet RD should be sufficient, taking into consideration the amount of decrease in volume of each red droplet RD in a heating step.

After all of the predetermined filter elements FE are filled with the red droplets RD, the wafer W is dried at a predetermined temperature (for example, approximately 70 degrees). When a solvent of the droplet RD evaporates, as shown in FIG. 2(*c*), the volume of the droplet RD decreases. If the volume is greatly decreased, the droplet RD landing operation and the drying operation are repeated until the viscous body achieves a sufficient thickness for the color filter substrate. With the processing, the solvent of the droplet RD evaporates. In the end, only the solid portion of the droplet RD is left to form a film.

The drying operation in the red pattern forming step is performed by the baking furnace 4 shown in FIG. 1. Since the dried wafer W is heated, the wafer W is carried by the robot 5*b* shown in the drawing to the cooler 6*a* and cooled. The cooled wafer W is temporarily stored in the buffer 6*c* for timing purposes. Subsequently, the wafer W is transferred to the wafer rotating table 6*b*. The plotting direction and the layout are determined, serving as the prearrangement for causing green droplets to land on the wafer W. The robot 9*a* holds the wafer W placed on the wafer rotating table 6*b* and transfers the wafer W to the droplet ejecting apparatus 7.

The droplet ejecting apparatus 7 causes, as shown in FIG. 2(*b*), green droplets GD to land onto the corresponding filter elements FE at predetermined positions for forming a predetermined pattern. The amount of each green droplet GD should be sufficient, taking into consideration the amount of decrease in volume of each green droplet GD in a heating step. After all of the predetermined filter elements FE are filled with the green droplets GD, the wafer W is dried at a predetermined temperature (for example, approximately 70 degrees). When a solvent of the droplet GD evaporates, as shown in FIG. 2(*c*), the volume of the droplet GD decreases. If the volume is greatly decreased, the droplet GD landing operation and the drying operation are repeated until the viscous body achieves a sufficient thickness for the color filter substrate. With the processing, the solvent of the droplet GD evaporates. In the end, only the solid portion of the droplet GD is left to form a film.

The drying operation in the green pattern forming step is performed by the baking furnace 8 shown in FIG. 1. Since the dried wafer W is heated, the wafer W is carried by the robot 9*b* shown in the drawing to the cooler 10*a* and cooled. The cooled wafer W is temporarily stored in the buffer 10*c* for timing purposes. Subsequently, the wafer W is transferred to the wafer rotating table 10*b*. The plotting direction and the layout are determined, serving as the prearrangement for causing blue droplets to land on the wafer W. The robot 13*a* holds the wafer W placed on the wafer rotating table 10*b* and transfers the wafer W to the droplet ejecting apparatus 11.

The droplet ejecting apparatus 11 causes, as shown in FIG. 2(*b*), blue droplets BD to land onto the corresponding filter elements FE at predetermined positions for forming a predetermined pattern. The amount of each blue droplet BD should be sufficient, taking into consideration the amount of decrease in volume of each blue droplet BD in a heating step. After all of the predetermined filter elements FE are filled with the blue droplets BD, as shown in FIG. 2(*c*), the wafer W is dried at a predetermined temperature (for example, approximately 70 degrees). When a solvent of the droplet BD evaporates, the volume of the droplet BD decreases. If the volume is greatly decreased, the droplet BD landing operation and the drying operation are repeated until the viscous body achieves a sufficient thickness for the color filter substrate. With the processing, the solvent of the droplet BD evaporates. In the end, only the solid portion of the droplet BD is left to form a film.

The drying operation in the blue pattern forming step is performed by the baking furnace 12 shown in FIG. 1. Since the dried wafer W is heated, the wafer W is carried by the robot 13*b* shown in the drawing to one of the wafer rotating tables 14*a* and 14*b*. Subsequently, the rotating direction is determined so that the wafer W faces a particular direction. The wafer W for which the rotating direction has been determined is received into one of the magazine unloaders 15*a* and 15*b* by the robot 13*b*. As discussed above, the RGB pattern forming step is completed. Subsequently, the back-end processing steps shown in FIG. 2(*d*) onward are continuously performed.

In a protective coating forming step shown in FIG. 2(*d*), which is one of the back-end processing steps, the wafer W is heated at a predetermined temperature for a predetermined period of time in order to completely dry the droplets RD, GD, and BD. When the wafer W is completely dried, a protective coating CR is formed to protect and smoothen the surface of the wafer W having formed thereon the viscous films. The protective coating CR is formed using a method such as spin coating, roll coating, or ripping. In a transparent electrode forming step shown in FIG. 2(*e*) subsequent to the protective coating forming step, a transparent electrode TL covering the entirety of the protective coating CR is formed using a method such as sputtering or vacuum attraction. In a patterning step shown in FIG. 2(*f*) subsequent to the transparent electrode forming step, the transparent electrode TL is patterned to generate pixel electrodes PL. When switching elements, such as TFTs (Thin Film Transistors), are used to drive a liquid crystal panel, the patterning step is unnecessary. After the steps described above, a color filter CF shown in FIG. 2(*f*) is manufactured.

Figure 4:
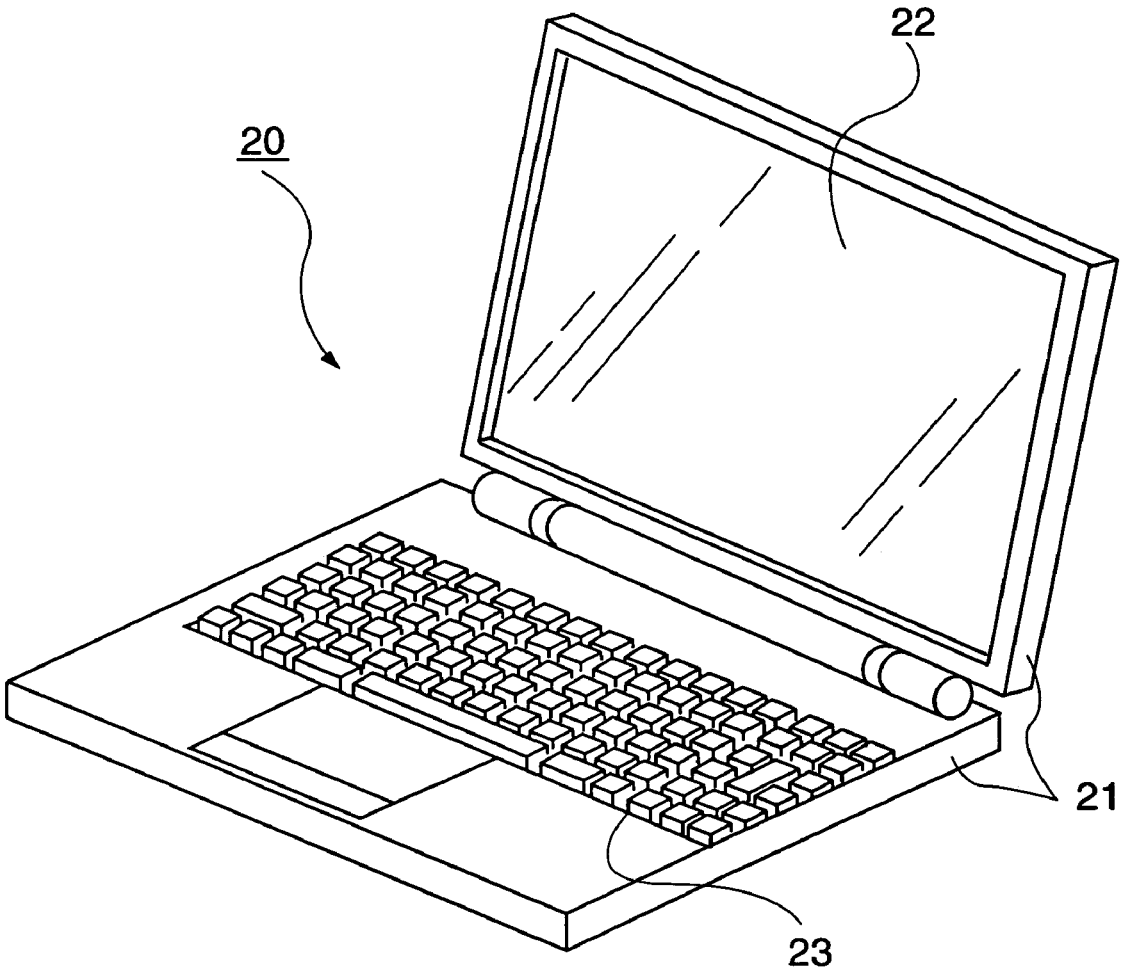
FIG. 4 is an illustration of an example of a device manufactured using a device manufacturing method according to an embodiment of the present invention.

After a step of disposing the color filter CF and a counter electrode (not shown) so as to face each other and providing liquid crystal therebetween, a liquid crystal display is manufactured. By putting electronic components, such as the liquid crystal display manufactured as described above, a motherboard having a CPU (Central Processing Unit) or the like, a keyboard, a hard disk, and the like in a casing, for example, a notebook personal computer 20 (device) shown in FIG. 4 is manufactured. FIG. 4 shows an example of a device manufactured using the device manufacturing method according to the embodiment of the present invention. In FIG. 4, reference numeral 21 represents the casing, reference numeral 22 represents the liquid crystal display, and reference numeral 23 represents the keyboard.

It should be understood that the device having the color filter substrate CF formed by the above-described manufacturing steps is not limited to the above-described notebook personal computer 20. The device can include various electronic devices such as a cellular phone, an electronic notebook, a pager, a POS terminal, an IC card, a mini disc player, a liquid crystal projector, an engineering work station (EWS), a word processor, a television, a viewfinder or monitor-direct-viewing video cassette recorder, an electronic calculator, a car navigation apparatus, a device with a touch panel, a timepiece, a game machine, and the like. Furthermore, the device manufactured by the above-described method using the droplet ejecting apparatus according to the embodiment is not limited to the color filter substrate CF. The device may be an organic EL (Electroluminescence) display, a microlens array, an optical element such as a spectacle lens having a coating layer on the surface thereof, and other devices.

Figure 5:
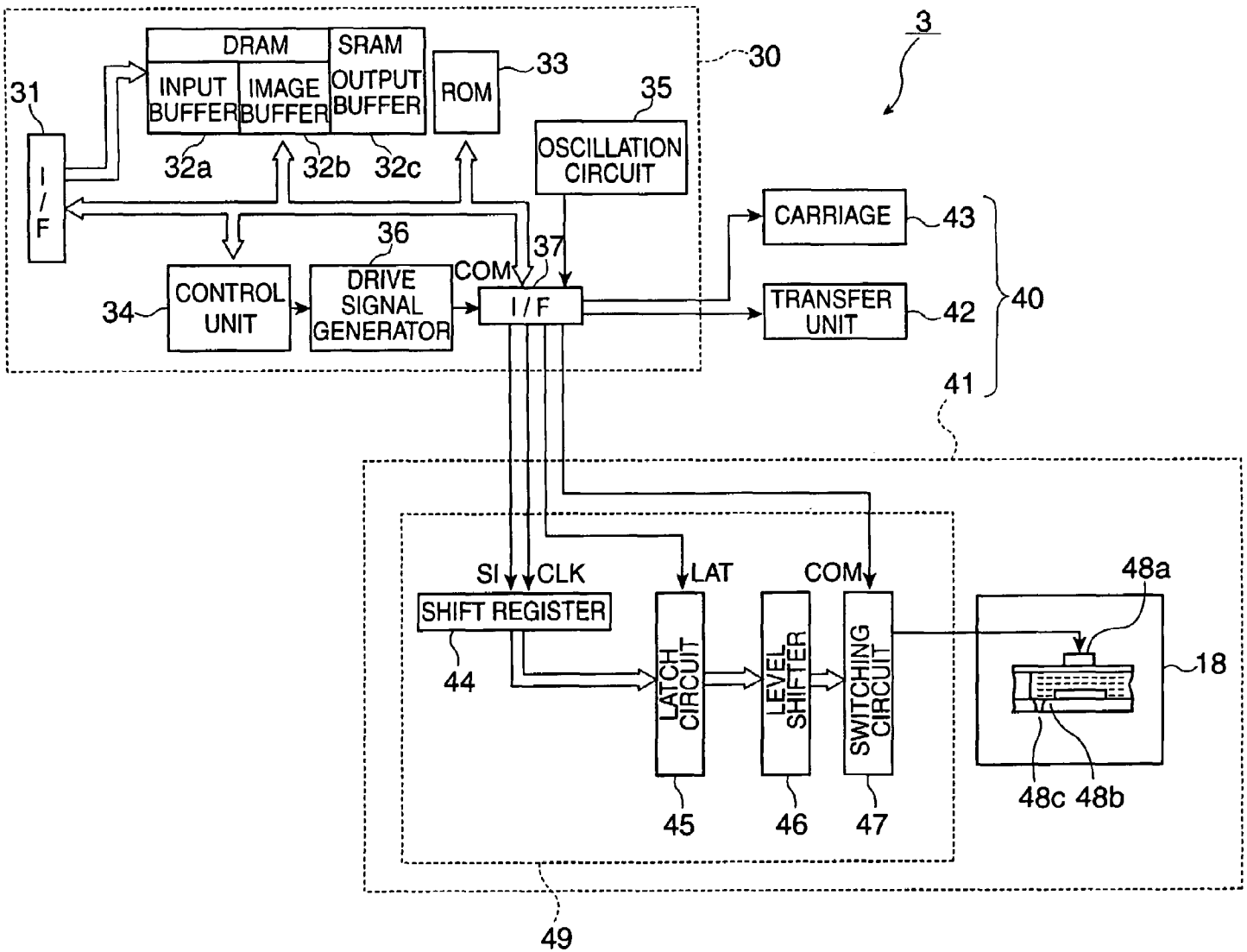
FIG. 5 is an exemplary block diagram showing the electrical configuration of the droplet ejecting apparatus and a head driving device according to an embodiment of the present invention.

The electrical configuration of the droplet ejecting apparatus and the head driving device according to an embodiment of the present invention will now be described. FIG. 5 is an exemplary block diagram showing the electrical configuration of the droplet ejecting apparatus and the head driving device according to the embodiment of the present invention. Since the droplet ejecting apparatuses 3, 7, and 11 have the same configuration, the droplet ejecting apparatus 3 is described by way of example.

In FIG. 5, the droplet ejecting apparatus 3 can include a print controller 30 and a print engine 40. The print engine 40 includes a write head 41, a transfer unit 42, and a carriage mechanism 43. The transfer unit 42 is for performing sub scanning by moving a platform on which a substrate such as the wafer W for use in the manufacture of a color filter substrate is placed. The carriage mechanism 43 performs main scanning using the write head 41.

The print controller 30 includes an interface 31 for receiving image data (recorded information) including multi-gray level information from a computer (not shown) or the like, an input buffer 32*a* and an image buffer 32*b*, each formed of a DRAM that stores various data such as recorded information including multi-gray level information, an output buffer 32*c* formed of an SRAM, a ROM 33 having recorded therein a program for performing various types of data processing, a control unit 34 including a CPU, a memory, and the like; an oscillation circuit 35, a drive signal generator 36 that generates a drive signal COM for the write head 41, and an interface 37 for outputting print data expanded in the form of dot pattern data and the drive signal to the print engine 40. The control unit 34 corresponds to frequency changing means of the present invention. The drive signal generator 36 corresponds to a drive signal generator of the present invention. The print controller 30 corresponds to a head driving device of the present invention.

The configuration of the write head 41 will now be described. The write head 41 ejects a droplet from each nozzle orifice 48*c* of a droplet ejecting head at a predetermined time on the basis of the print data and the drive signal COM output from the print controller 30. The write head 41 includes a plurality of nozzle orifices 48*c*, a plurality of pressure generating chambers 48*b* in communication with the corresponding nozzle orifices 48*c*, and a plurality of pressure generating elements 48*a* for pressurizing viscous bodies in the corresponding pressure generating chambers 48*b* and ejecting droplets from the corresponding nozzle orifices 48*c*. Also, the write head 41 is provided with a head drive circuit 49 including a shift register 44, a latch circuit 45, a level shifter 46, and a switching circuit 47.

The overall operation of the droplet ejecting apparatus, which has the above-described configuration, ejecting a droplet will now be described. Recorded data SI expanded by the print controller 30 in the form of dot pattern data is serially output to the head drive circuit 49 of the write head 41 via the interface 37 in synchronization with a clock signal CLK from the oscillation circuit 35. The recorded data SI is serially transferred to the shift register 44 of the write head 41 and sequentially set. In this case, the most significant bit (MSB) data of the recorded data SI at each nozzle is serially transferred. When the serial transfer of the MSB data is completed, the second significant bit data is serially transferred. In like manner, the less significant bits are serially transferred one after another.

When the bits of the recorded data at all nozzles are set in elements of the shift register 44, the control unit 34 outputs a latch signal LAT to the latch circuit 45 at a predetermined time. In response to the latch signal LAT, the latch circuit 45 latches the recorded data set in the shift register 44. The recorded data latched by the latch circuit 45 is applied to the level shifter 46, which is a voltage transducer. When the recorded data SI is, for example, "1", the level shifter 46 outputs a voltage value that can drive the switching circuit 47, for example, a voltage value of dozens of volts. Each switching element included in the switching circuit 47 becomes connected upon application of a signal output from the level shifter 46 thereto. The drive signal COM output from the drive signal generator 36 is supplied to each switching element included in the switching circuit 47. When each switching element in the switching circuit 47 is connected, the drive signal COM is applied to the corresponding voltage generating element 48*a* connected to each switching element.

The write head 41 can thus control whether or not to apply the drive signal COM to each pressure generating element 48*a* on the basis of the recorded data SI. For example, each switching element included in the switching circuit 47 is connected in a period during which the recorded data SI is "1". Thus, the drive signal COM is supplied to the corresponding pressure generating element 48*a*. In response to the supplied drive signal COM, the pressure generating element 48*a* is displaced (deformed). In contrast, each switching element included in the switching circuit 47 is disconnected in a period during which the recorded data SI is "0". Thus, the supply of the drive signal COM to the corresponding pressure generating element 48*a* is cut off. In the period during which the recorded data SI is "0", each pressure generating element 48*a* maintains the previous charge. As a result, the previous displacement state is maintained. When one switching element included in the switching circuit 47 is in its ON state and the drive signal COM is applied to the corresponding pressure generating element 48*a*, the pressure generating chamber 48*b* in communication with the nozzle orifice 48*c* contracts, thereby pressurizing a viscous body in the pressure generating chamber 48*b*. As a result, the viscous body in the pressure generating chamber 48*b* is ejected as a droplet from the nozzle orifice 48*c* to form a dot on the substrate. With the above-described operation, a droplet is ejected from the droplet ejecting apparatus.

Figure 6:
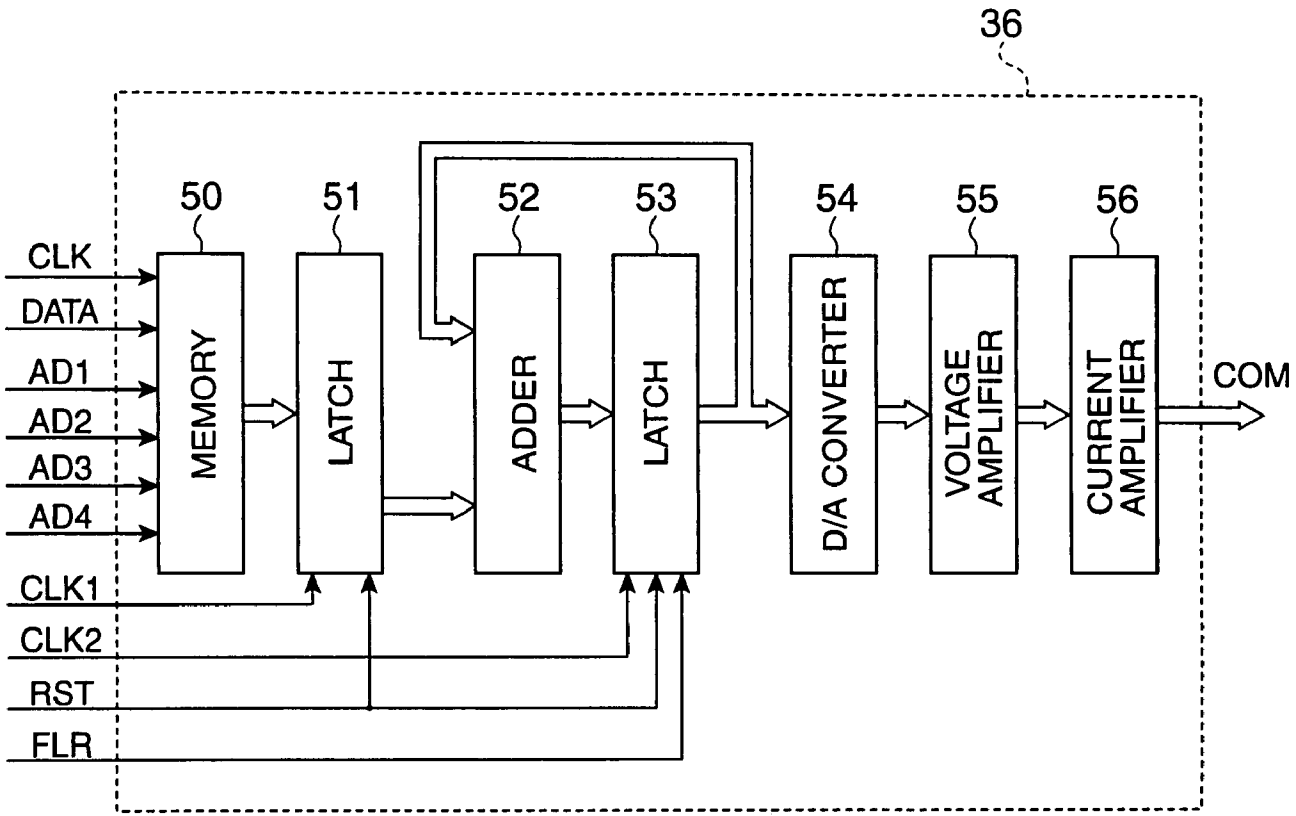
FIG. 6 is an exemplary block diagram showing the configuration of the drive signal generator 36.

The control unit 34 and the drive signal generator 36, which are features of the present invention, will now be described. FIG. 6 is an exemplary block diagram showing the configuration of the drive signal generator 36. The drive signal generator 36 shown in FIG. 6 generates the drive signal COM on the basis of various data stored in a data storage unit in the control unit 34. As shown in FIG. 6, the drive signal generator 36 can include a memory 50 that receives and temporarily stores various signals from the control unit 34, a latch 51 that reads and temporarily stores the contents of the memory 50, an adder 52 that adds the output from the latch 51 and the output from a latch 53, a D/A converter 54 that converts the output from the latch 53 into an analog signal, a voltage amplifier 55 that amplifies the analog signal generated by the D/A converter 54 to the voltage of the drive signal COM, and a current amplifier 56 that amplifies the current of the drive signal COM, whose voltage has been amplified by the voltage amplifier 55.

The control unit 34 supplies a clock signal CLK, data signals DATA, address signals AD1 to AD4, clock signals CLK1 and CLK2, a reset signal RST, and a floor signal FLR to the drive signal generator 36. The clock signal CLK is a signal at the same frequency (for example, approximately 10 MHz) as that of the clock signal CLK output from the oscillation circuit 35. Each of the data signals DATA is a signal indicating the amount of change in voltage of the drive signal COM. The address signals AD1 to AD4 are signals specifying addresses at which the data signals DATA are stored. Although a detailed description will be given later, when generating the drive signal COM, the control unit 34 outputs a plurality of data signals DATA, each indicating the amount of change in voltage, to the drive signal generator 36. The address signals AD1 to AD4 are thus necessary for separately storing the data signals DATA.

The clock signal CLK1 is a signal that defines the start point and the end point of a period during which the voltage value of the drive signal COM is changed. The clock signal CLK2 is a signal corresponding to a reference clock that defines the operation timing of the drive signal generator 36. The clock signal CLK2 is a signal whose frequency changes in accordance with a deformation rate of the pressure generating element 48*a* per unit time. The frequency of the clock signal CK2 is variable because the pressure generating element 48*a* needs to be gradually deformed in order that a sufficient amount of a droplet can be ejected since the viscosity of the droplet ejected from the droplet ejecting apparatus is high and the amount of droplet ejected at one time is a few micrograms, which is a few hundred times greater than the amount ejected by a known droplet ejecting apparatus.

The clock signal CLK2 is generated by dividing, for example, by the control unit 34, the reference clock signal CLK output from the oscillation circuit 35. The division ratio of the reference clock CLK is appropriately set in accordance with the deformation rate of the pressure generating element 48*a* per unit time. This point will be described in detail later. The reset signal RST is a signal that sets the output of the adder 52 to "0" by initializing the latch 51 and the latch 52. The floor signal FLR is a signal for clearing the lower eight bits of the latch 51 (18 bits of the latch 53) when changing the voltage value of the drive signal COM.

Figure 7:
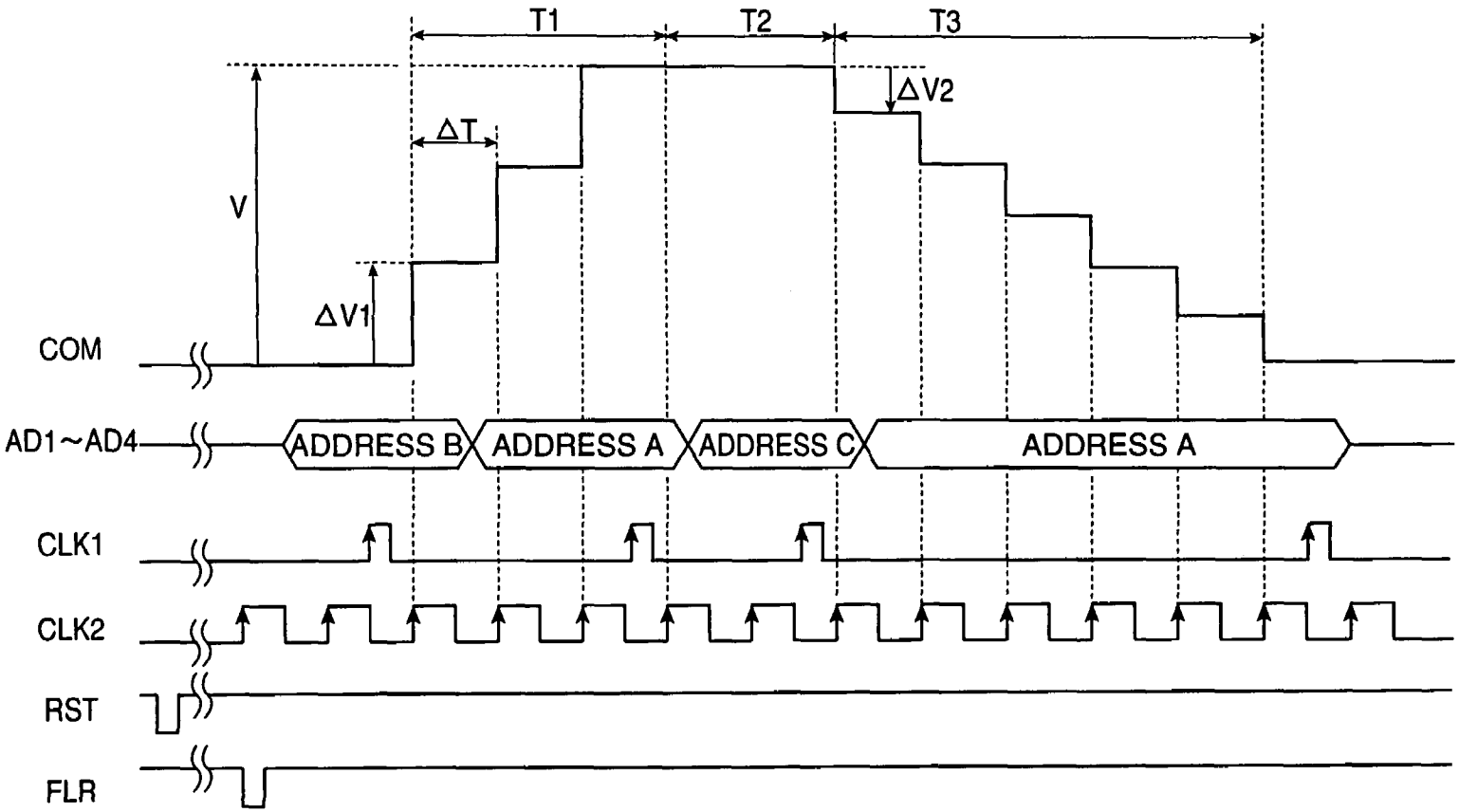
FIG. 7 is a diagram illustrating an example of the waveform of a drive signal generated by the drive signal generator 36.
Figure 8:
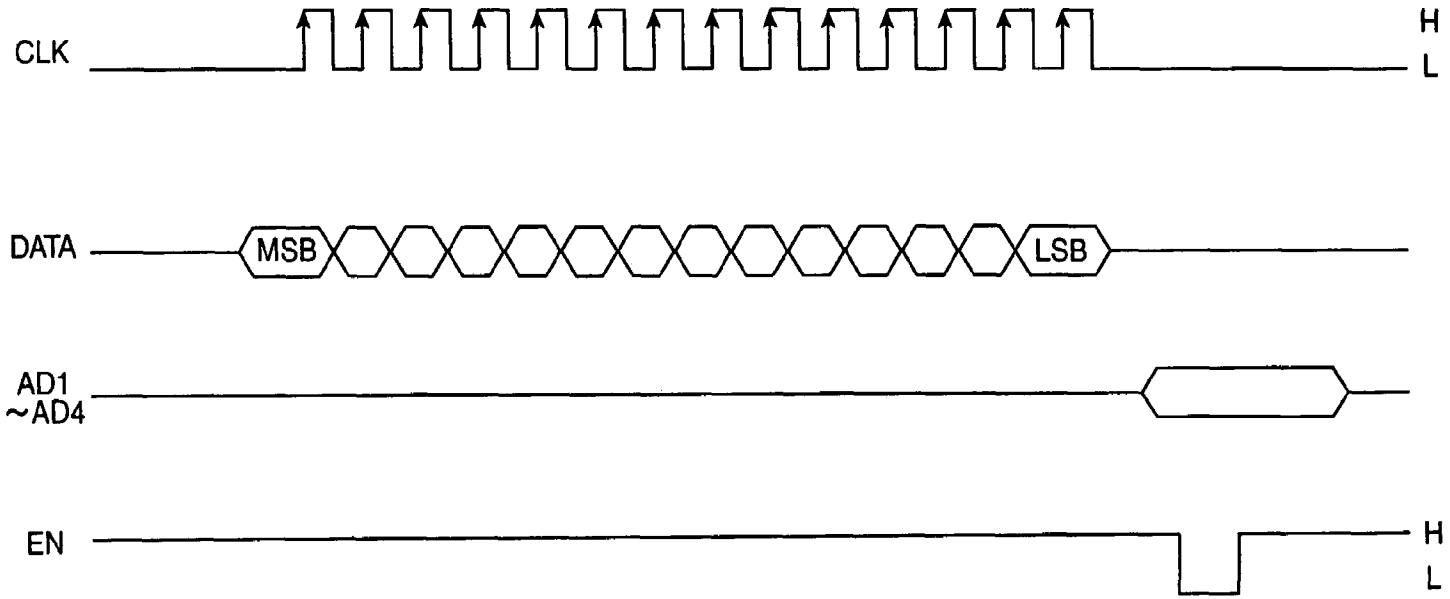
FIG. 8 is a timing chart illustrating the time at which the control unit 34 transfers a data signal DATA and address signals AD1 to AD4 to the drive signal generator 36.

An example of the waveform of the drive signal COM generated by the drive signal generator 36 arranged as described above will now be described. FIG. 7 is a diagram illustrating an example of the waveform of the drive signal generated by the drive signal generator 36. As shown in FIG. 7, prior to the generation of the drive signal COM, the control unit 34 outputs a few data signals DATA, each indicating the amount of change in voltage, and address signals AD1 to AD4 indicating the addresses of the data signals DATA to the drive signal generator 36 in synchronization with the clock signal CLK. Each data signal DATA is, as shown in FIG. 8, serially transferred in synchronization with the clock signal CLK. FIG. 8 is an exemplary timing chart illustrating the time at which the control unit 34 transfers the data signal DATA and the address signals AD1 to AD4 to the drive signal generator 36.

As shown in FIG. 8, when the control unit 34 transfers the data DATA indicating a predetermined amount of change in voltage, the data signal DATA formed of a plurality of bits is output in synchronization with the clock signal CLK. The address at which the data signal DATA is stored is output in the form of address signals AD1 to AD4 in synchronization with an enable signal EN. The memory 50 shown in FIG. 6 reads the address signals AD1 to AD4 at the time the enable signal EN is output and writes the received data signal DATA at the address indicated by the address signals AD1 to AD4. Since each of the address signals AD1 to AD4 is a four-bit signal, the memory 50 can store a maximum of 16 types of data signals DATA, each indicating the amount of change in voltage.

The MSB of each data signal DATA is used to indicate the sign. The above-described processing is performed, and the data signals DATA are stored in the memory 50 at addresses designated by the address signals AD1 to AD4. In this case, the data signals are stored at addresses A, B, and C. Also, the reset signal RST and the floor signal FLR are input to initialize the latches 51 and 53.

After the setting of the amount of change in voltage to the addresses A, B, . . . , is completed, as shown in FIG. 7, when the address B is designated by the address signals AD1 to AD4, the amount of change in voltage corresponding to the address B is maintained by the latch 51 in response to the first clock signal CLK1. In this state, when the next clock signal CLK2 is input, the latch 53 maintains the sum of the output of the latch 53 and the output of the latch 51. Once the amount of change in voltage is maintained by the latch 51, subsequently the output of the latch 53 is increased or decreased by the amount of change in voltage every time the clock signal CLK2 is input. The slew rate of the drive waveform is determined by the amount of change in voltage AV1 stored in the memory 50 at the address B and the cycle ΔT of the clock signal CLK2. Whether the output is increased or decreased is determined by the sign of data stored at each address.

In the example shown in FIG. 7, the value 0, that is, the value for maintaining the voltage, is stored as the amount of change in voltage at the address A. When the address A is enabled by the clock signal CLK1, the waveform of the drive signal COM is maintained flat in which there is no increase or decrease. The amount of change in voltage AV2 per cycle of the clock signal CLK2 is stored at the address C in order to determine the slew rate of the drive waveform. After the address C is enabled by the clock signal CLK1, the voltage is decreased by AV2. As discussed above, the waveform of the drive signal COM is freely controlled simply by outputting, from the control unit 34, the address signals AD1 to AD4 and the clock signals CLK1 and CLK2 to the drive signal generator 36.

The above-described operation is the basic operation for controlling the waveform of the drive signal COM. In this embodiment, the slew rate of the drive signal COM is changed by supplying the clock signal CLK2 from the control unit 34 to the drive signal generator 36, the clock signal CLK2 being generated by setting the division ratio in accordance with the deformation rate of each pressure generating element 48*a* per unit time. For this reason, a plurality of frequency divider circuits for dividing the clock signal CLK output from the oscillation circuit 35 is disposed in the control unit 34. The division ratio of each frequency divider circuit is set to, for example, 2 to 14. It is assumed that the frequency of the clock signal CLK is 10 MHz. The frequency divider circuit whose division ratio is set to 1 generates the clock signal CLK2 at a frequency of $10/2^1=5$ MHz (cycle: 0.2 μs). The frequency divider circuit whose division ratio is set to 13 generates the clock signal CLK2 at a frequency of $10/2^{13}\approx1.22$ kHz (cycle: approximately 0.82 ms). The frequency divider circuit whose division ratio is set to 14 generates the clock signal CLK2 at a frequency of $10/2^{14}\approx610$ Hz (cycle: approximately 1.64 ms).

In the waveform of the drive signal COM shown in FIG. 7, a period during which the voltage value increases is referred to as a rising period T1, a period during which the voltage value does not change is referred to as a maintaining period T2, and a period during which the voltage value decreases is referred to as a falling period T3. In order to eject a highly viscous body, the following parameters for causing the drive signal generator 36 to generate the drive signal COM are set in the control unit 34. That is, the rising period T1 is 1 s, the maintaining period T2 is 500 ms, and the falling period T3 is ~20 μs. The rising period T1, the maintaining period T2, and the falling period T3 are set in accordance with the viscosity of the viscous body. The viscosity of the viscous body is within the range from 10 to 40000 [mPa·s] at room temperature (25° C.).

The rising period T1 is set to approximately 1 second in order to prevent bubbles from entering from the nozzle orifice 48*c*, which are caused by deformation of the meniscus due to the high viscosity of the viscous body when the pressure generating element 48*a* is quickly deformed. The maintaining period T2 is set to approximately half the rising period T1 (approximately 500 ms) in order to avoid effects of the natural frequency of the droplet ejecting head 18, which is determined by the structure of the droplet ejecting head 18.

In other words, after the rising period T1 elapses, the surface tension of the viscous body causes vibrations at the natural frequency of the droplet ejecting head 18. The vibrations are attenuated over time, and, in the end, stopped. Since it is unfavorable that the viscous body is ejected while the surface of the viscous body is vibrating, the maintaining period T2 is set to a sufficient length of time for the vibrations to stop. The falling period T3 is set to a short period of time, such as approximately 20 μs, in order to achieve the ejecting speed for ejecting the viscous body.

In order to simplify the description, it is assumed that the data signal DATA indicating the amount of change in voltage of the drive signal COM is an unsigned 10-bit signal. In this case, there are $2^{10}=1024$ possible combinations for the value of the amount of change in voltage. When the minimum amount of change in voltage is input in order to generate a gradually rising waveform, the voltage value of the drive signal COM changes from the minimum value to the maximum value over a period of 1024 clocks of the clock signal CLK.

When the clock signal CLK2 at a frequency of 10 MHz is input, the voltage value of the drive signal COM changes from the minimum value to the maximum value over a time period of 0.1 μs×1024=102.4 μs. When the clock signal CLK2 at a frequency of 1.22 kHz is input, the voltage value of the drive signal COM changes from the minimum value to the maximum value over a time period of 0.82 ms×1024≈0.84 s. When the clock signal CLK2 at a frequency of 610 Hz is input, the voltage value of the drive signal COM changes from the minimum value to the maximum value over a time period of 1.64 ms×1024≈1.68 s.

In the rising period T1, the control unit 34 generates the clock signal CLK2 by dividing the clock signal CLK by 14 using the frequency divider circuit whose division ratio is set to 14. In the maintaining period T2, the control unit 34 generates the clock signal CLK2 by dividing the clock signal CLK using the frequency divider circuit whose division ratio is set to 13. In the falling period T3, the control unit 34 generates the undivided clock signal CLK2. As described above, the voltage value of the drive signal COM is increased or decreased every time the clock signal CLK2 is input. This point is the same in this embodiment. However, since the control unit 34 supplies the clock signal CLK2 whose frequency varies in accordance with the division ratio to the drive signal generator 36, the increasing rate and decreasing rate (slew rate) of the voltage value of the drive signal COM per unit time can be controlled. In the above example, the division ratio differs between the rising period T1 set to 1 s and the maintaining period T2 set to 500 ms in order to minimize the time error in the rising period T1 and the time error in the maintaining period T2.

Figure 9:
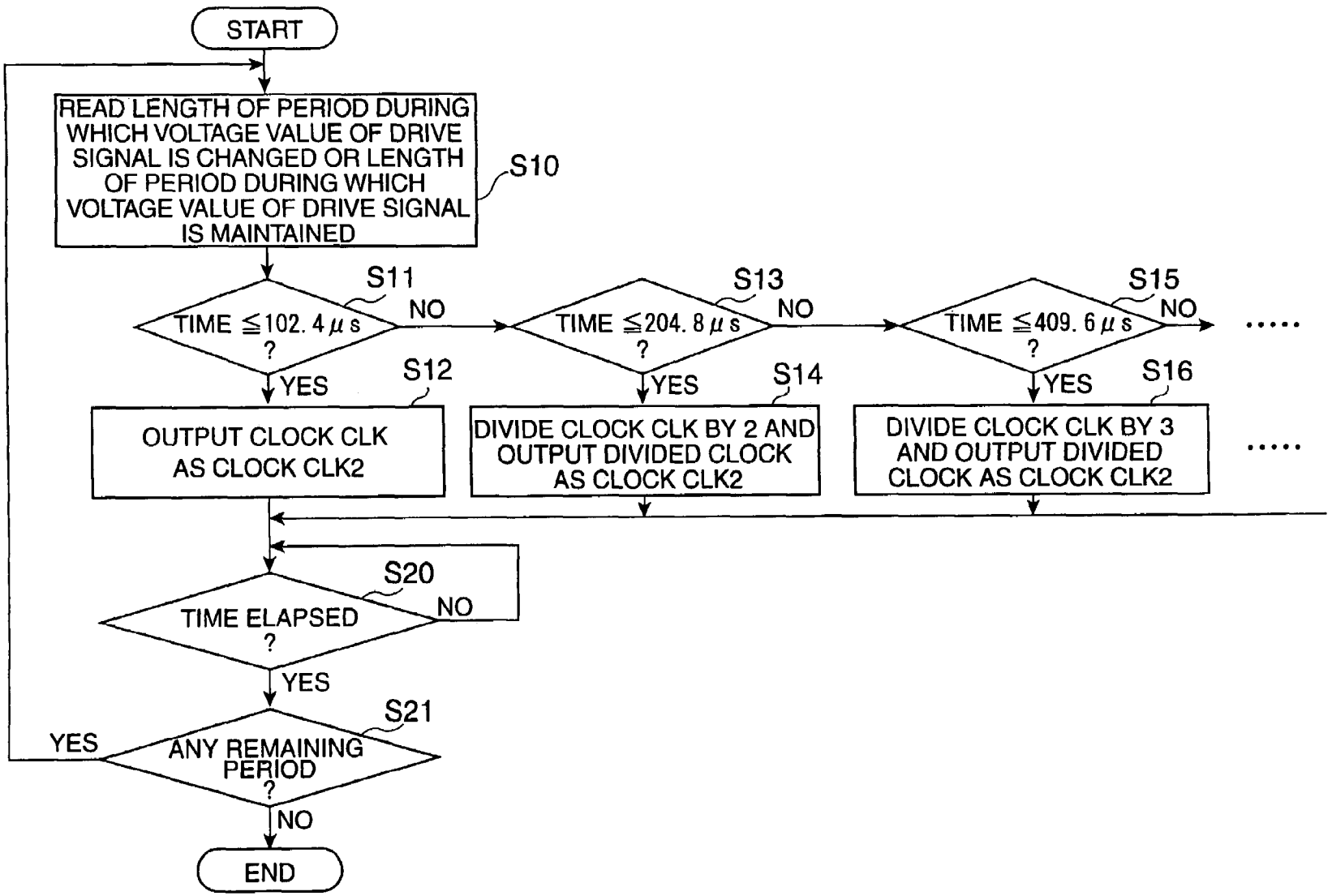
FIG. 9 is a flowchart showing an exemplary operation of the control unit 34 when changing the frequency of a clock signal CLK2.

FIG. 9 is a flowchart showing an exemplary operation of the control unit 34 when changing the frequency of the clock signal CLK2. As described above, the control unit 34 has a plurality of frequency divider circuits, each having a different division ratio. The flowchart shown in FIG. 9 shows a process of determining, by a CPU included in the control unit 34, which frequency divider circuit to use to divide the frequency. When generating the drive signal COM, the CPU included in the control unit 34 reads data indicating a period during which the voltage value of the drive signal COM is changed or a period during which the voltage value is maintained, from various data stored in advance in a data storage unit in the control unit 34 (step S10). The read data indicating the period is, for example, data indicating the time length of the period T1 shown in FIG. 7. When the data is read, the control unit 34 determines whether or not the length (time) of the read period is less than or equal to 102.4 μs (step S11). The time 102.4 μs corresponds to a period of 1024 cycles of the clock signal CLK.

When it is determined that the length (time) of the read period is less than or equal to 102.4 μs (when the determination in step S11 is "YES"), the control unit 34 outputs the clock CLK as the clock signal CLK2 (without dividing the clock signal CLK) to the drive signal generator 36 (step S12). In contrast, when it is determined in step S11 that the length (time) of the read period is greater than 102.4 μs (when the determination in step S11 is "NO"), it is determined whether or not the time is less than or equal to 204.8 μs (step S13). The time 204.8 μs corresponds to a period of 1024 cycles of a signal generated by dividing the clock signal CLK by 2. When the determination is "YES", the control unit 34 divides the clock signal CLK by 2 and generates the divided signal as the clock signal CLK2 to the drive signal generator 36 (step S14).

Similarly, when it is determined in step S13 that the length (time) of the read period is greater than 204.8 μs (when the determination in step S13 is "NO"), it is determined whether or not the time is less than or equal to 409.6 μs (step S15). The time 409.6 μs corresponds to a period of 1024 cycles of a signal generated by dividing the clock signal CLK by 3. When the determination is "YES", the control unit 34 divides the clock signal CLK by 3 and supplies the divided signal as the clock signal CLK2 to the drive signal generator 36 (step S16). From this point onward, similarly, the division ratio of the clock signal CLK is selected in accordance with the length of the period read in step S10. Steps S11 to S16 shown in FIG. 9 correspond to a frequency changing step or a selection step of the present invention.

When step S12, S14, S16, . . . is completed, it is determined whether or not the period has elapsed (step S20). In other words, it is determined whether or not the rising period T1 shown in FIG. 7 (period during which the voltage value of the drive signal COM is increased) has ended and it is now changed to the maintaining period T2 (period during which the voltage value of the drive signal COM is maintained). When the determination is "NO", the control unit 34 repeats the processing in step S20 to continuously output the cock signal CLK2 whose division ratio has been selected by performing the processing in steps S11 to S16 shown in FIG. 9. As a result, the voltage value of the drive signal COM is increased, maintained, or decreased.

When the determination in step S20 is "YES", it is determined whether or not there is enough period to generate the waveform of the drive signal COM (step S21). For example, when the rising period T1 has elapsed at the present moment, the maintaining period T2 and the falling period T3 during which the waveform of the drive signal COM is generated remain. Thus, the determination in step S21 is "YES". The process returns to step S10 and repeats the above-described processing. In contrast, when it is determined in step S21 that there is no time remaining, a series of steps of generating the waveform of the drive signal COM is terminated.

A head driving method according to the embodiment of the present invention has been described. The above-described head driving method is described using a case in which the drive signal COM formed of the rising period T1, the maintaining period T2, and the falling period T3 shown in FIG. 7 is generated. It should be understood that the head driving device and method of this embodiment are not limited to the above case in which the drive signal COM formed of the three periods is generated, but are also applicable to a case in which, for example, a drive signal COM with a waveform shown in FIG. 10 is generated.

Figure 10:
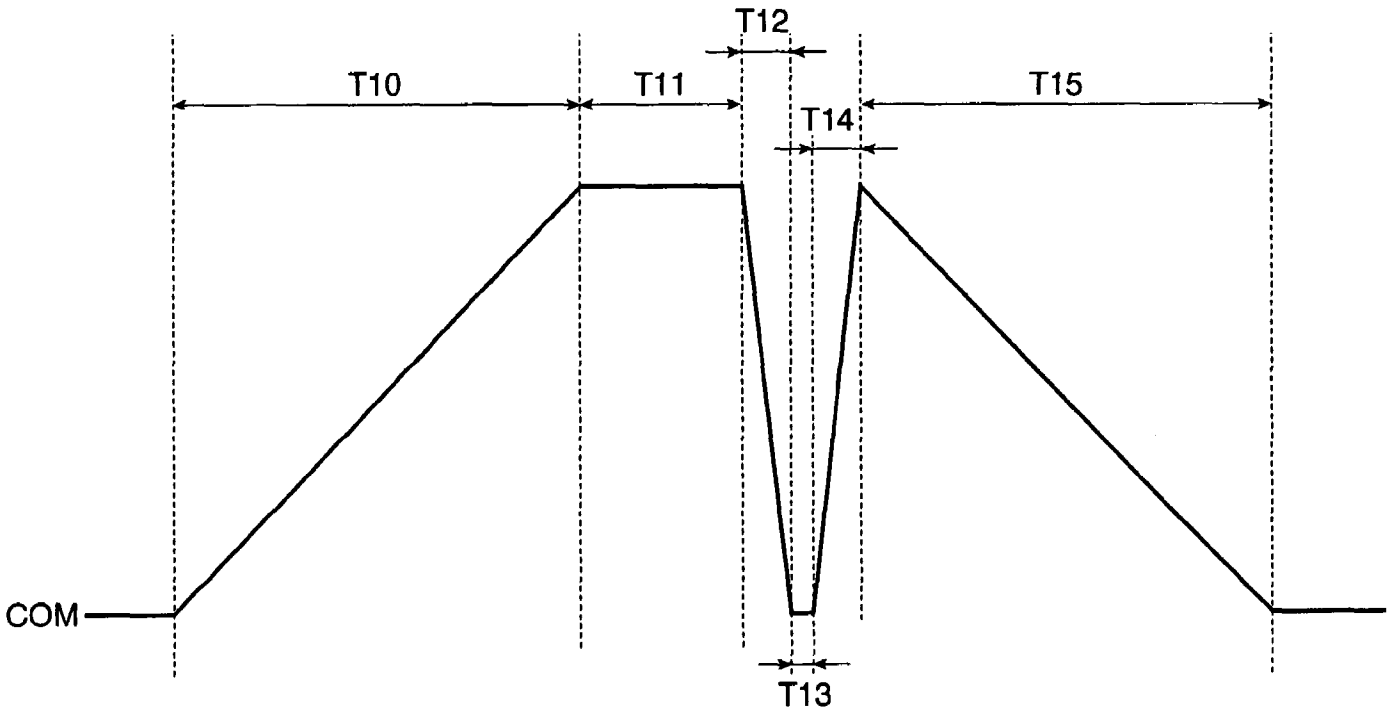
FIG. 10 is a diagram showing the waveform of the drive signal COM taking into consideration a satellite accompanying a droplet after the droplet is ejected and the meniscus of a viscous body.

FIG. 10 is an exemplary diagram showing the waveform of the drive signal COM taking into consideration a satellite accompanying a droplet after the droplet is ejected and the meniscus of the viscous body. In order to eject a highly viscous body, for example, after the pressure generating element 48*a* is gradually deformed and the viscous body is pulled into the droplet ejecting head 18, the pressure generating element 48*a* needs to be quickly deformed (restored) to achieve a certain degree of speed at which the droplet is ejected. For this reason, as shown in FIG. 10, a period T10 during which the pressure generating element 48*a* is deformed is set to a long time period (approximately 1 s), and a period T12 during which the pressure generating element 48*a* is restored is set to a short time period (approximately 20 μs).

Figure 11:
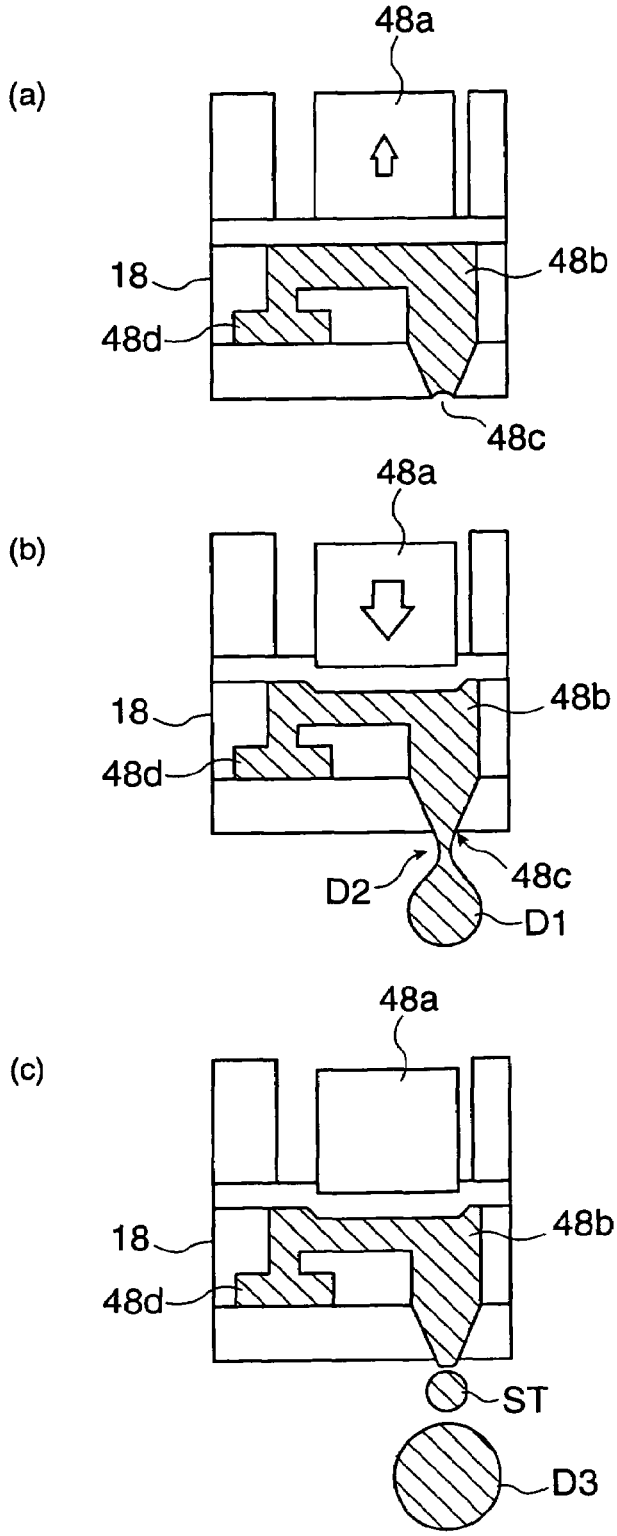
FIG. 11 includes illustrations for describing the droplet ejecting operation of a droplet ejecting head 18 upon application of the drive signal COM having a waveform including periods T10 to T13 shown in FIG. 10.

The droplet ejecting operation of the droplet ejecting head 18 upon application of the drive signal COM having the waveform including the periods T10 to T13 shown in FIG. 10 will now be described. FIG. 11 includes illustrations for describing the droplet ejecting operation of the droplet ejecting head 18 upon application of the drive signal COM having the waveform including the periods T10 to T13 shown in FIG. 10. When the voltage value of the drive signal COM is gradually increased in the period T10, as shown in FIG. 11(*a*), the pressure generating element 48*a* of the droplet ejecting head 18 is gradually deformed, and the viscous body is supplied from a fluid chamber 48*d* to the pressure generating chamber 48*b*. At the same time, as shown in the illustration, a slight portion of the viscous body near the nozzle orifice 48*c* is pulled into the interior of the pressure generating chamber 48*b*.

In the period T11, the voltage value of the drive signal COM is maintained for a predetermined time period (for example, 500 ms). Subsequently, when the pressure generating element 48*a* is quickly deformed (restored) in the period T12 over a time period of approximately 20 μs, as shown in FIG. 11(*b*), a droplet D1 is ejected from the nozzle orifice 48*c*. After the period T12 has elapsed, when the voltage value of the drive signal COM is not changed, part of a tail D2 of the droplet D1 shown in FIG. 11(*b*) is separated since the viscous body has a high viscosity. As shown in FIG. 11(*c*), a satellite ST other than a proper droplet D3 is generated. The satellite ST may splash in a direction differing from the droplet D3. When the droplet D3 lands on the surface, the landing surface may be contaminated. When the drive signal having the waveform including the periods T10 to T12 shown in FIG. 10 is intermittently applied to the pressure generating element 48*a* to continuously eject droplets at predetermined time intervals, the meniscus at the nozzle orifice 48*c* is deformed due to the high viscosity of the viscous body. This results in a situation unfavorable to the ejection of droplets.

In order to prevent such problems, periods T14 and T15 (after-care period) during which the pressure generating element 48*a* is deformed by a predetermined amount are provided subsequent to the periods T10 to T12 of the waveform shown in FIG. 10. The drive signal in the periods T14 and T15 corresponds to an auxiliary drive signal of the present invention. The after-care period is provided subsequent to the period T13 set to, for example, approximately 10 μs, subsequent to the period T12. The period T14 of the after-care period is set to approximately 20 μs, and the period T15 is set to approximately 1 s. The period T14 is set to a short time period of approximately 20 μs in order to prevent the satellite ST by quickly deforming the pressure generating element 48*a* and thus pulling back part of the droplet ejected from the nozzle orifice 48*c*. The period T15 is set to a long period of approximately 1 s in order to prevent the meniscus from deforming.

Figure 12:
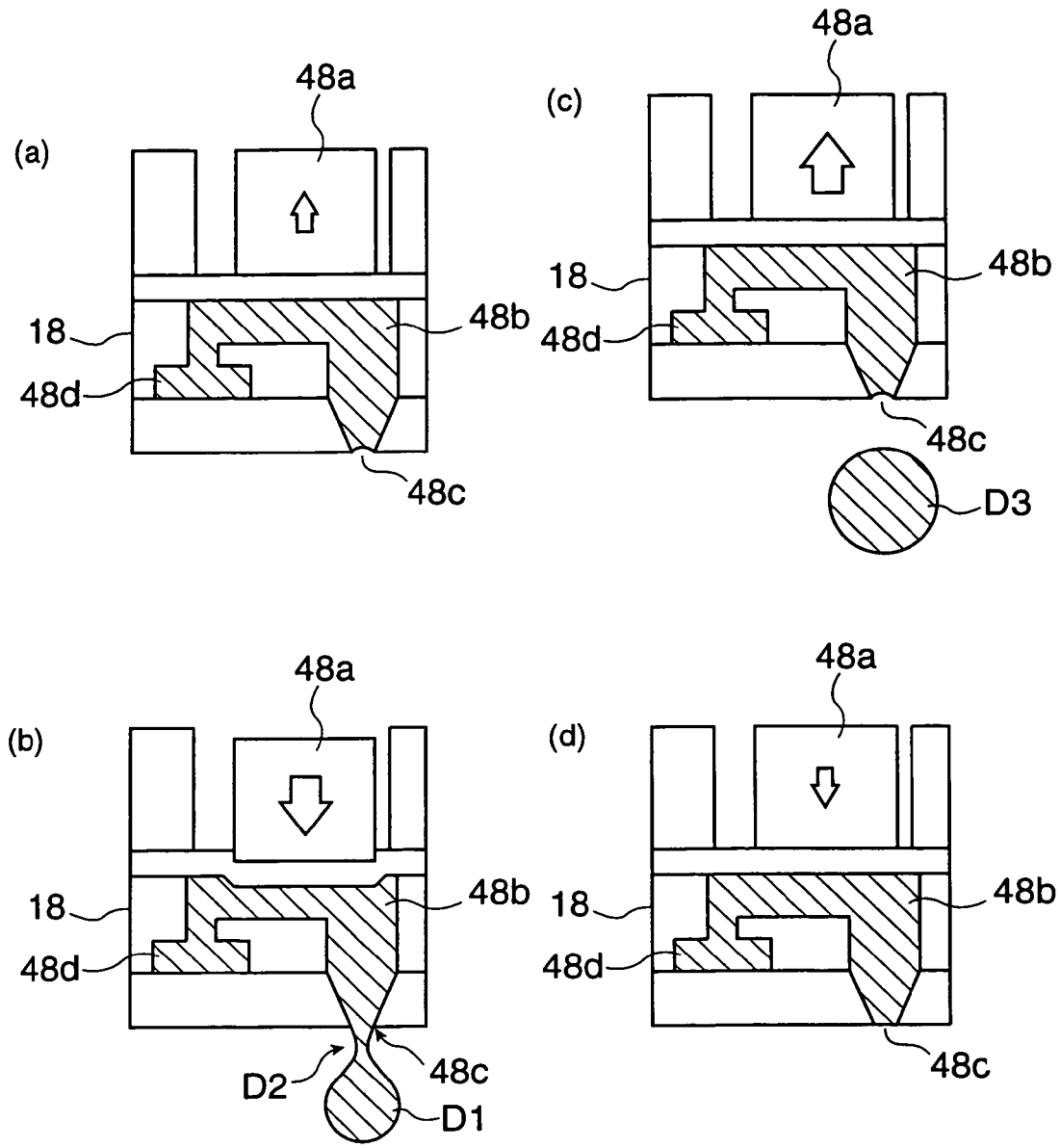
FIG. 12 includes illustrations for describing the droplet ejecting operation of the droplet ejecting head 18 upon application of the drive signal COM including an after-care period.

This will now be described using FIG. 12. FIG. 12 includes illustrations for describing the droplet ejecting operation of the droplet ejecting head 18 upon application of the drive signal COM including the after-care period. In the period T10 shown in FIG. 10, the voltage value of the drive signal COM is gradually increased. As shown in FIG. 12(*a*), the pressure generating element 48*a* of the droplet ejecting head 18 is gradually deformed, and the viscous body is supplied from the fluid chamber 48*d* to the pressure generating chamber 48*b*. As shown in the illustration, a slight portion of the viscous body near the nozzle orifice 48*c* is pulled into the interior of the pressure generating chamber 48*b*.

In the period T11, the voltage value of the drive signal COM is maintained for a predetermined period of time (for example, 50 ms). Subsequently, in the period T12, the pressure generating element 48*a* is quickly deformed (restored) in a time period of approximately 20 μs. As shown in FIG. 12(*b*), the droplet D1 is ejected from the nozzle orifice 48*c*. After the period T12 has elapsed, the period T13 elapses. In the period T14, the drive signal COM having the waveform shown in the illustration is applied to the pressure generating element 48*a*. In response, the pressure generating element 48*a* is deformed as shown in FIG. 12(*c*). Part of the droplet D1 ejected from the nozzle orifice 48*c* (tail D2 shown in FIG. 12(*b*)) is pulled into the interior of the nozzle orifice 48*c*. Accordingly, since the tail D2 that causes the satellite ST is pulled into the interior of the nozzle orifice 48*c*, the satellite is prevented from being generated.

As discussed above, the waveform in the period T14 makes it possible to prevent the generation of a satellite. In the period T14, the pressure generating element 48*a* is deformed. As shown in FIG. 12(*c*), the surface of the viscous body is pulled into the interior of the nozzle orifice 48*c*, and the meniscus is slightly deformed. In order to correct the deformation, the pressure generating element 48*a* is gradually deformed (restored) in the period T15, and the meniscus is maintained at a predetermined state (see FIG. 12(*d*)).

When the droplet ejecting head 18 is driven by the drive signal COM including the after-care period, the pressure generating element 48*a* needs to be gradually deformed in the period T10 and the period T15, and the pressure generating element 48*a* needs to be quickly restored and deformed in the period T12 and the period T14. Such a drive signal COM whose waveform partially includes a low slew rate and a high slew rate is generated by simply changing the division ratio of the clock signal CLK in accordance with the slew rate in this embodiment. The waveform of the drive signal COM can be arbitrarily set by taking into consideration the surface state of the viscous body, the satellite, and the like.

Figure 13:
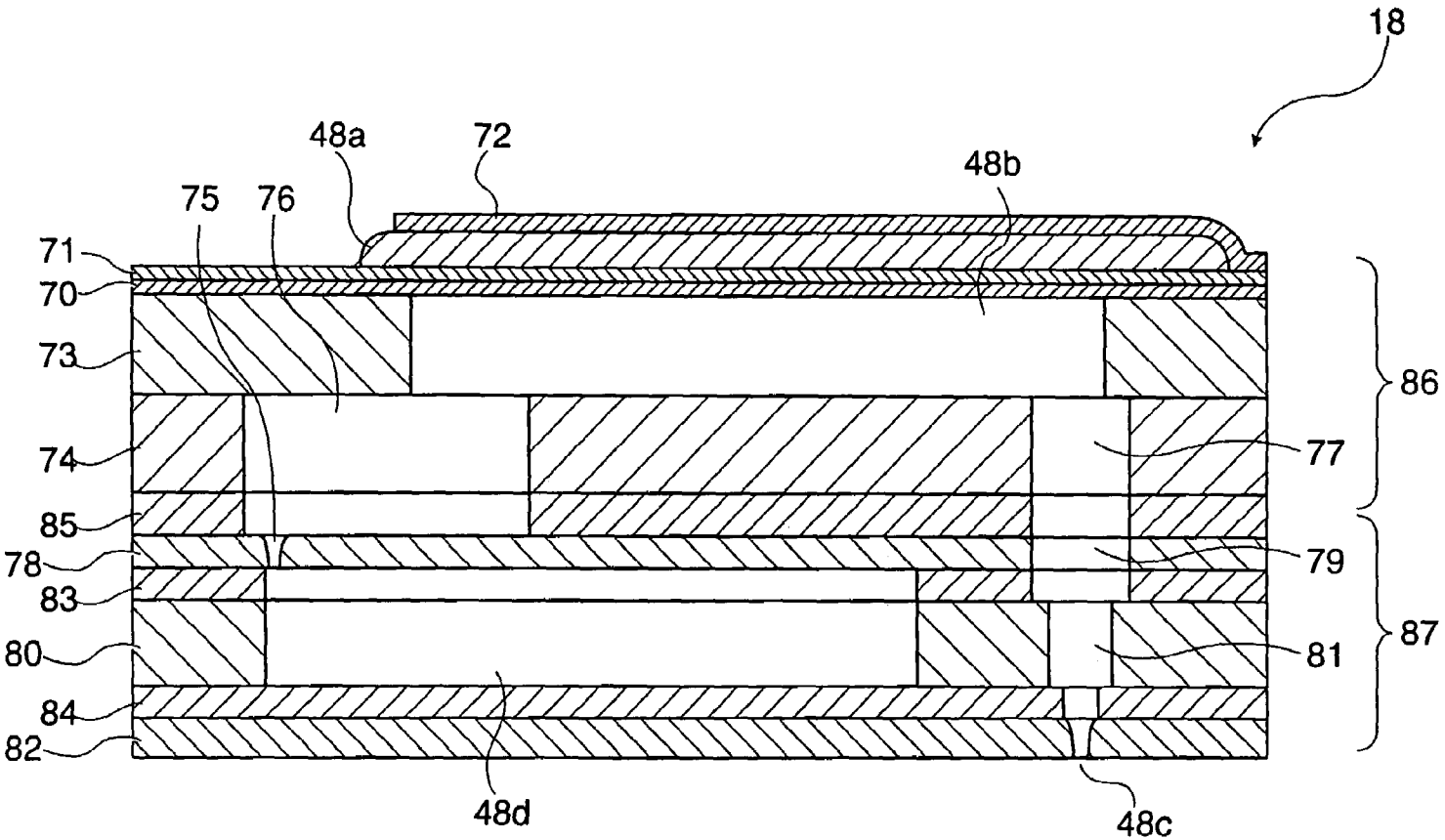
FIG. 13 is an illustration showing an example of the cross section of the mechanical structure of the droplet ejecting head 18.

In the above description, the droplet ejecting head 18 having a simplified configuration has been described. Hereinafter the specific configuration of the droplet ejecting head 18 is described. FIG. 13 is an illustration showing an example of the cross section of the mechanical structure of the droplet ejecting head 18. In FIG. 13, a first lid member 70 is formed of a zirconia ($ZrO_2$) sheet that is approximately 6 μm thick. A common electrode 71, which serves as one polarity, is arranged on the surface of the first lid member 70. As described later, the pressure generating element 48*a* formed of PZT or the like is fixed on the surface of the common electrode 71. A drive electrode 72 formed of a relatively flexible metal layer of Au or the like is provided on the surface of the pressure generating element 48*a*.

The pressure generating element 48*a* in conjunction with the first lid member 70 functions as a flexible vibration actuator. When the pressure generating element 48*a* is charged, the pressure generating element 48*a* contracts and deforms, thereby reducing the volume of the pressure generating chamber 48*b*. When the pressure generating element 48*a* is discharged, the pressure generating element 48*a* expands and deforms, thereby expanding the volume of the pressure generating chamber 48*b* to the original state. A spacer 73 is a ceramic sheet formed of zirconia or the like. The spacer 73 is approximately 100 μm thick and has a through hole. Both sides of the spacer 73 are sealed by the first lid member 70 and a second lid member 74, which is described below, to define the pressure generating chamber 48*b*.

The second lid member 74 is formed of a ceramic sheet made of zirconia or the like, as in the first lid member 70. The second lid member 74 includes a communicating hole 76 that connects the pressure generating chamber 48*b* with a viscous body supply orifice 75, which is described below, and a nozzle communicating hole 77 that connects the other end of the pressure generating chamber 48*b* with the nozzle orifice 48*c*. The second lid member 74 is fixed on the other side of the spacer 73. Without using adhesive agents, the above-described first lid member 70, the spacer 73, and the second lid member 74 are contained in an actuator unit 86 by shaping viscous ceramic materials into specific forms, stacking the shaped components, and baking the stacked components.

A viscous body supply orifice forming substrate 78 can include the above-described viscous body supply orifice 75 and a communicating hole 79. The viscous body supply orifice forming substrate 78 also serves as a fixing substrate of the actuator unit 86. A fluid chamber forming substrate 80 includes a through hole serving as the fluid chamber 48*d* and a communicating hole 81 connecting to the communicating hole 79 included in the viscous body supply orifice forming substrate 78. A nozzle plate 82 can include the nozzle orifice 48*c* for ejecting the viscous body. The viscous body supply orifice forming substrate 78, the fluid chamber forming substrate 80, and the nozzle plate 82 are fixed with adhesive layers 83 and 84 such as thermal adhesive films or adhesive agents therebetween and contained in a flow channel unit 87. The flow channel unit 87 and the above-described actuator unit 86 are fixed with an adhesive layer 85, such as a thermal adhesive film or an adhesive agent, to form the droplet ejecting head 18.

In the droplet ejecting head 18 structured as described above, when the pressure generating element 48*a* is discharged, the pressure generating chamber 48*b* expands, and the pressure in the pressure generating chamber 48*b* is reduced, thereby introducing the viscous body from the fluid chamber 48*d* to the pressure generating chamber 48*b*. In contrast, when the pressure generating element 48*a* is charged, the pressure generating chamber 48*b* contracts, and the pressure in the pressure generating chamber 48*b* is increased, thereby ejecting the viscous body in the pressure generating chamber 48*b* through the nozzle orifice 48*c* in the form of a droplet.

Figure 14:
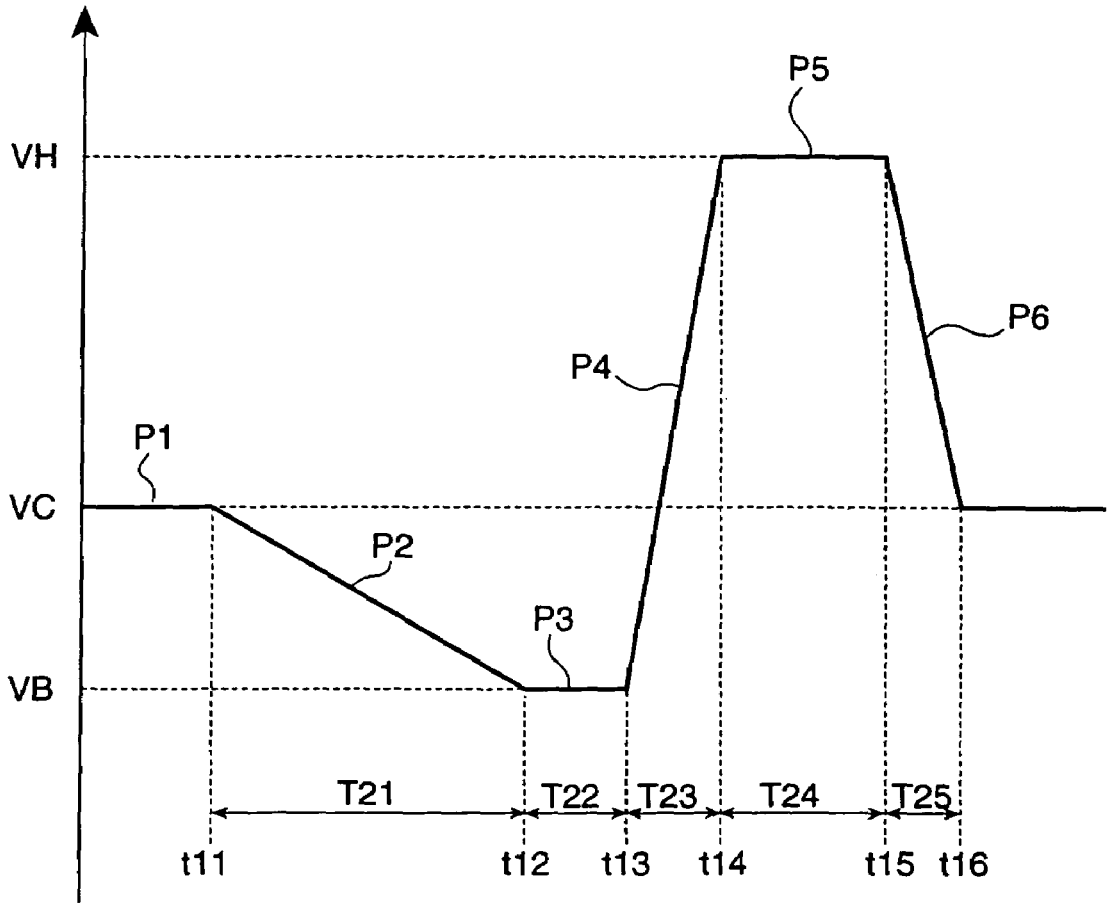
FIG. 14 is a diagram showing the waveform of the drive signal COM supplied to the droplet ejecting head 18 having the structure shown in FIG. 13.

FIG. 14 is an exemplary diagram showing the waveform of the drive signal COM supplied to the droplet ejecting head 18 having the structure shown in FIG. 13. In FIG. 14, the drive signal COM for actuating the pressure generating element 48*a* is maintained at the midpoint potential VC for a predetermined period until time t11 (holding pulse P1). Subsequently, the voltage value is reduced at a constant slope to the minimum potential VB in a period T21 from time t11 to time t12 (discharging pulse P2). In the period T21, the processing shown in FIG. 9 is performed. The clock signal CLK2 generated by dividing the clock signal CLK by the division ratio in accordance with the rate of change in voltage value of the drive signal COM per unit time is supplied from the control unit 34 to the drive signal generator 36, thereby generating the drive signal.

After the minimum potential VB is maintained for a period T22 from time t12 to time t13 (holding pulse P3), the voltage value is increased at a constant slope in a period T23 from time t13 to time t14 to the maximum potential VH (charging pulse P4). The maximum potential VH is maintained for a predetermined period until time t15 (holding pulse P5). Subsequently, the voltage value is again reduced to the midpoint potential VC in a period T25 until time t16 (discharging pulse P6).

When such a drive signal COM is applied to the droplet ejecting head 18 shown in FIG. 13, while the holding pulse P1 is applied, the meniscus of the viscous body, part of which has been ejected as a droplet upon the previous application of the charging pulse, vibrates around the nozzle orifice 48*c* on a predetermined cycle due to the surface tension of the viscous body. As time passes, the vibrations of the meniscus are attenuated and consequently stopped. Next, upon application of the charging pulse P2, the pressure generating element 48*a* bends in a direction that will expand the volume of the pressure generating chamber 48*b*, and a negative pressure is generated in the pressure generating chamber 48*b*. As a result, the meniscus starts moving toward the interior of the nozzle orifice 48*c*, and the meniscus is pulled into the interior of the nozzle orifice 48*c*.

This state is maintained while the holding pulse P3 is applied. Subsequently, upon application of the charging pulse P4, a positive pressure is generated in the pressure generating chamber 48*b*. The meniscus is pushed out of the nozzle orifice 48*c*, and a droplet is ejected. Subsequently, upon application of the charging pulse P6, the pressure generating element 48*a* bends in a direction that will expand the volume of the pressure generating chamber 48*b*, and a negative pressure is generated in the pressure generating chamber 48*b*. As a result, the meniscus starts moving toward the interior of the nozzle orifice 48*c*. Due to the surface tension of the viscous body, the meniscus vibrates around the nozzle orifice 48*c* on a predetermined cycle. As time passes, the vibrations of the meniscus are attenuated and again stopped. The waveform of the drive signal supplied to the droplet ejecting head 18 shown in FIG. 13 has been described. In order to maintain the meniscus at a predetermined state and prevent satellites, preferably the after-care period shown in FIG. 10 is provided to generate a waveform in accordance with the viscosity of the viscous body and the response characteristics of the droplet ejecting head 18.

Figure 15:
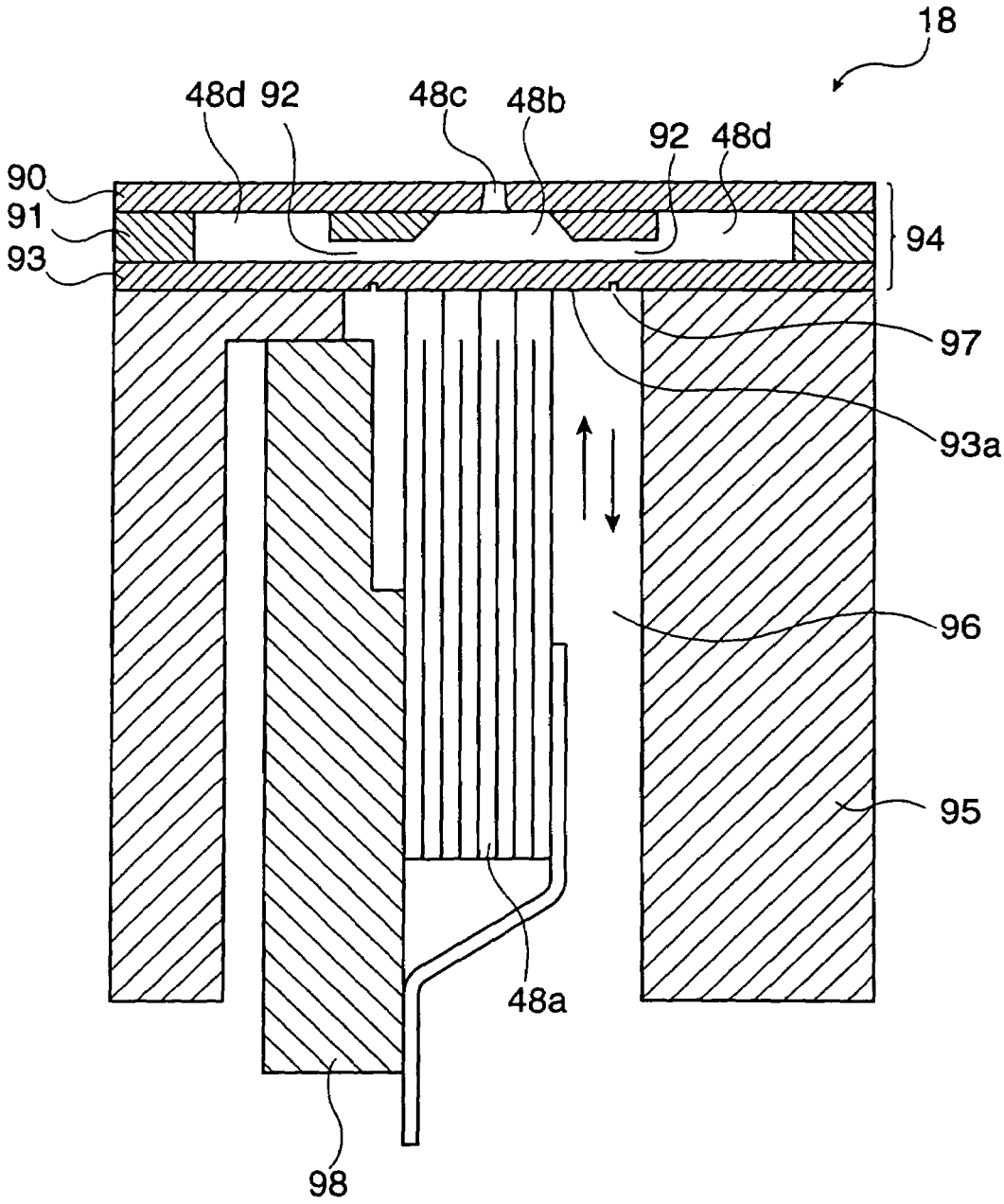
FIG. 15 is an illustration showing another example of the cross section of the mechanical structure of the droplet ejecting head 18.

FIG. 15 is an illustration showing another example of the cross section of the mechanical structure of the droplet ejecting head 18. In FIG. 15, an example of the cross section of the mechanical structure of the write head 41 in which a piezoelectric vibrator that generates stretching vibrations is used as a pressure generating element. In the droplet ejecting head 18 shown in FIG. 15, reference numeral 90 represents a nozzle plate, and reference numeral 91 represents a flow channel forming plate. The nozzle plate 90 includes the nozzle orifice 48*c*. The flow channel forming plate 91 includes a through hole defining the pressure generating chamber 48*b*, through holes or grooves defining two viscous body supply orifices 92 in communication with the pressure generating chamber 48*b* at both sides thereof, and through holes defining two common fluid chambers 48*d* in communication with the viscous body supply orifices 92, respectively.

A vibrating plate 93 made of an elastically deformable sheet is in contact with the leading edge of the pressure generating element 48*a*, such as a piezoelectric element, and integrally fixed, in a fluid-tight manner, to the nozzle plate 90 with the flow channel forming plate 91 therebetween, thus providing a flow channel unit 94. A base 95 includes a receiving chamber 96 receiving the pressure generating element 48*a* that can be vibrated; and an aperture 97 supporting the flow channel unit 94. While the leading edge of the pressure generating element 48*a* is exposed from the aperture 97, the pressure generating element 48*a* is fixed by a fixing base 98. The base 95 arranges the droplet ejecting head 18 by fixing the flow channel unit 94 to the aperture 97 while having an island portion 93*a* of the vibrating plate 93 in contact with the pressure generating element 48*a*.

Figure 16:
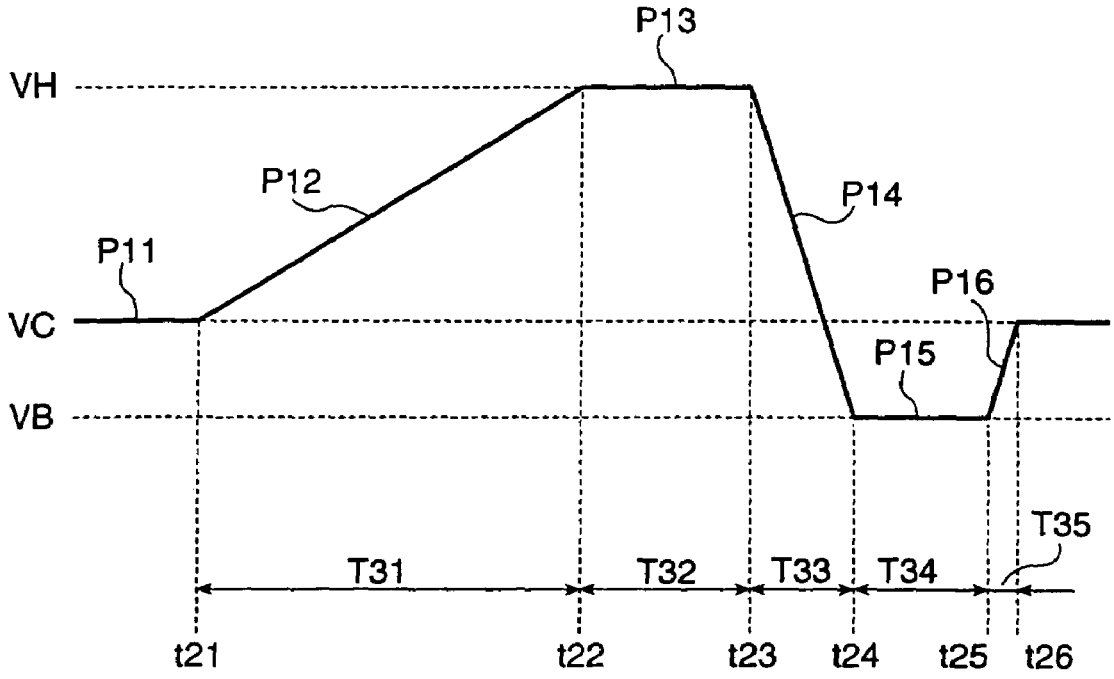
FIG. 16 is a diagram showing the waveform of the drive signal COM supplied to the droplet ejecting head 18 having the structure shown in FIG. 15.

FIG. 16 is an exemplary diagram showing the waveform of the drive signal COM supplied to the droplet ejecting head 18 having the structure shown in FIG. 15. In FIG. 16, the drive signal COM for actuating the pressure generating element 48*a* starts at a voltage value of the midpoint potential VC (holding pulse P11). Subsequently, the voltage value is increased at a constant slope to the maximum potential VH in a period T31 from time t21 to time t22 (charging pulse P12). In the period T31, the processing shown in FIG. 9 is performed. The clock signal CLK2 generated by dividing the clock signal CLK by the division ratio in accordance with the rate of change in voltage value of the drive signal COM per unit time is supplied from the control unit 34 to the drive signal generator 36, thereby generating the drive signal.

After the maximum potential VH is maintained for a period T32 from time t22 to time t23 (holding pulse P3), the voltage value is reduced at a constant slope in a period T33 from time t23 to time t24 to the minimum potential VB (discharging pulse P4). The minimum potential VB is maintained for a predetermined period of a period T34 from time t24 to time t25 (holding pulse P15). The voltage value is increased at a constant slope to the midpoint potential VC in a period T35 from time t25 to time t26 (charging pulse P16).

Upon application of the charging pulse P12 included in the drive signal COM to the pressure generating element 48*a* in the write head 41 arranged as described above, the pressure generating element 48*a* bends in a direction that will expand the volume of the pressure generating chamber 48*b*, and a negative pressure is generated in the pressure generating chamber 48*b*. As a result, the meniscus is pulled into the interior of the nozzle orifice 48*c*. Next, upon application of the discharging pulse P14, the pressure generating element 48*a* bends in a direction that will contract the volume of the pressure generating chamber 48*b*, and a positive pressure is generated in the pressure generating chamber 48*b*. As a result, a droplet is ejected from the nozzle orifice 48*c*. After application of the holding pulse P15, the charging pulse P16 is applied to suppress vibrations of the meniscus. The waveform of the drive signal supplied to the droplet ejecting head 18 shown in FIG. 15 has been described. In order to maintain the meniscus at a predetermined state and prevent satellites, preferably the drive signal supplied to the droplet ejecting head 18 arranged as described above includes the after-care period shown in FIG. 10, thereby generating a waveform in accordance with the viscosity of the viscous body and the response characteristics of the droplet ejecting head 18.

As described above, according to the head driving device and method of this embodiment, the clock signal CLK2 generated by dividing, by the control unit 34, the clock signal CLK is supplied to the drive signal generator 36, and the drive signal generator 36 generates, in synchronization with the clock signal CLK2, the drive signal COM applied to the droplet ejecting head 18. The rate of change in voltage value of the drive signal COM per unit time can thus be arbitrarily set in accordance with the division ratio for generating the clock signal CLK2. Accordingly, the pressure generating element 48*a* included in the droplet ejecting head 18 can be gradually deformed or restored, or the pressure generating element 48*a* can be deformed or restored in a short time period of hundreds nanoseconds.

In order to eject a highly viscous body, the viscous body needs to be gradually pulled into the interior of the droplet ejecting head 18 (the pressure generating chamber 48*b*), and a droplet thereof needs to be ejected at a certain degree of speed. In this embodiment, as described above, the pressure generating element 48*a* can be gradually deformed or restored in a few seconds, or the pressure generating element 48*a* can be deformed or restored in a short time period of hundreds nanoseconds. Therefore, this embodiment is highly suitable to ejecting a highly viscous body.

Since the rate of change in voltage value of the drive signal COM per unit time is set in accordance with the division ratio for generating the clock signal CLK2 in this embodiment, it should be understood that this embodiment is not particularly limited to the form of applicable waveforms. A waveform can be easily generated that can maintain the meniscus at a satisfactory state at all times and that can prevent satellites from being generated during the droplet ejecting operation. As a result, a predetermined amount of a viscous body can be ejected at all times with a high degree of accuracy.

In this embodiment, the division ratio for generating the clock signal CLK2 is variable in order that the rate of change in voltage value of the drive signal COM per unit time can be changed. In order to have a variable division ratio for generating the clock signal CLK2, there is no need for a big change in the configuration of the apparatus as this can be achieved almost only by a change in software. This requires almost no new manufacturing facilities and can be achieved using existing facilities. By using a known apparatus, the resource can be utilized. The device manufacturing method of this embodiment manufactures a device by a manufacturing step employing the droplet ejecting apparatuses 3, 7, and 11. Accordingly, the device manufacturing method is flexibly applicable to changes in specifications of products and the like, and devices according to various specifications can be manufactured.

Although the exemplary embodiments of the present invention have been described, it should be understood that the present invention is not limited to the above-described embodiments. Changes can be made in the present invention without departing from the spirit and scope of the present invention. For example, in the above-described embodiments, as shown in FIG. 1, the droplet ejecting apparatus 3 for releasing the red (R) droplets, the droplet ejecting apparatus 7 for releasing the green (G) droplets, and the droplet ejecting apparatus 11 for releasing the blue (B) droplets are separately provided. In this example, the device manufacturing system is such that the droplet ejecting heads 18 included in the droplet ejecting apparatuses 3, 7, and 11 eject the single color droplets.

However, the present invention is also applicable to a droplet ejecting head in which an inkjet head ejecting red droplets, an inkjet head ejecting green droplets, and an inkjet head ejecting blue droplets are all integrated. Also, for example, when metal materials or insulating materials are applied to the viscous body jet patterning technology of this apparatus, direct micro-patterning of metal wiring, insulating films, and the like is made possible. This is applicable to the manufacture of new highly-functional devices.

The device manufacturing system including the droplet ejecting apparatus of this embodiment forms the R (red) pattern, then the G (green) pattern, and finally the B (blue) pattern. However, it should be understood that the pattern formation is not limited to this order. If necessary, the patterns may be formed in a different order. In the above-described embodiments, the highly viscous body has been described by way of example of the viscous body. However, the present invention is not limited to the ejection of viscous bodies. The present invention is also applicable to the ejection of viscous liquids or resins in general. In the above-described embodiments, the case in which the piezoelectric vibrator is used as the pressure generating element of the droplet ejecting head has been described. However, the present invention is also applicable to a droplet ejecting apparatus including a droplet ejecting head that generates a pressure in a pressure generating chamber upon application of heat. The entirety or part of a program implementing the above-described head driving method may be stored in a computer-readable flexible disk, CD-ROM, CD-R, CD-RW, DVD (registered trademark), DVD-R, DVD-RW, DVD-RAM, magneto-optical disk, streamer, hard disk, memory, or any other recording medium.

What is claimed is:

1. A head driving device operating in synchronization with a reference clock and ejecting a viscous body by applying a drive signal to a pressure generating element included in a head, and thus deforming the pressure generating element, comprising:

a frequency changing device configured to variably change a frequency of a signal from the reference clock during ejecting the viscous body based on a surface tension of the viscous body; and a drive signal generator configured to generate the drive signal using both the signal output by the frequency changing device and the signal from the reference clock.

2. The head driving device according to claim 1, the frequency changing device changing the frequency of the signal of the reference clock by dividing the signal of the reference clock.

3. A droplet ejecting apparatus comprising the head driving device as set forth in claim 1.

4. The head driving device according to claim 1, the frequency changing device reducing ejection of the viscous body when the viscous body is vibrating by variably changing a frequency of a signal from the reference clock during ejecting the viscous body according to a surface tension of the viscous body.

5. A head driving method for a head driving device operating in synchronization with a reference clock and ejecting a viscous body by applying a drive signal to a pressure generating element included in a head, and thus deforming the pressure generating element, the method comprising:

variably changing a frequency of a signal from the reference clock during ejecting the viscous body based on a surface tension of the viscous body; and generating the drive signal using both the signal produced in the step of variably changing a frequency of a signal and the signal from the reference clock.

6. The head driving method according to claim 5, the frequency of the signal of the reference clock being changed by dividing the signal of the reference clock.

7. A processor executable medium including a program for performing a head driving method, which when executed by the processor, causes the processor to perform the method as set forth in claim 5.

8. A device manufacturing method comprising, as one device manufacturing step, a step of ejecting a viscous body using the head driving method as set forth in claim 5.

9. The head driving method according to claim 5, further comprising:

reducing ejection of the viscous body when the viscous body is vibrating by variably changing a frequency of a signal from the reference clock during ejecting the viscous body according to a surface tension of the viscous body.

* * * * *